US009090051B2

(12) United States Patent
Takahashi et al.

(10) Patent No.: US 9,090,051 B2
(45) Date of Patent: Jul. 28, 2015

(54) SHEET BINDING DEVICE, SHEET PROCESSING APPARATUS, IMAGE FORMING APPARATUS, IMAGE FORMING SYSTEM, AND SHEET BINDING METHOD

(71) Applicants: Wataru Takahashi, Toyko (JP); Nobuyoshi Suzuki, Tokyo (JP); Yuusuke Shibasaki, Kanagawa (JP); Ryuji Yoshida, Kanagawa (JP); Takashi Saito, Kanagawa (JP); Akihiro Musha, Kanagawa (JP); Katsuhiro Kosuge, Kanagawa (JP); Shingo Matsushita, Tokyo (JP); Takuya Morinaga, Tokyo (JP); Ikuhisa Okamoto, Kanagawa (JP)

(72) Inventors: Wataru Takahashi, Toyko (JP); Nobuyoshi Suzuki, Tokyo (JP); Yuusuke Shibasaki, Kanagawa (JP); Ryuji Yoshida, Kanagawa (JP); Takashi Saito, Kanagawa (JP); Akihiro Musha, Kanagawa (JP); Katsuhiro Kosuge, Kanagawa (JP); Shingo Matsushita, Tokyo (JP); Takuya Morinaga, Tokyo (JP); Ikuhisa Okamoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/161,794

(22) Filed: Jan. 23, 2014

(65) Prior Publication Data

US 2014/0219747 A1 Aug. 7, 2014

(30) Foreign Application Priority Data

Feb. 1, 2013 (JP) ..... 2013-018453

(51) Int. Cl.
*B31F 5/02* (2006.01)
*B41F 9/00* (2006.01)

(Continued)

(52) U.S. Cl.
CPC . *B41F 9/008* (2013.01); *B31F 5/02* (2013.01); *B42B 5/00* (2013.01); *B42C 1/12* (2013.01);
(Continued)

(58) Field of Classification Search
CPC ..... B42F 3/003; B41F 5/02; B41F 1/07; B41F 2201/0712; B65H 39/06; B65H 2301/51616; G03G 15/6544
USPC ..... 270/58.07, 58.08; 412/6; 399/407, 408
See application file for complete search history.

(56) References Cited

U.S. PATENT DOCUMENTS
6,217,016 B1 4/2001 Honmochi et al.
8,246,033 B2 * 8/2012 Sato ..... 270/58.09

(Continued)

FOREIGN PATENT DOCUMENTS
JP 07-165365 6/1995

(Continued)

OTHER PUBLICATIONS
Extended European Search Report dated May 22, 2014.

*Primary Examiner* — Leslie A Nicholson, III
(74) *Attorney, Agent, or Firm* — Harness, Dickey & Pierce, P.L.C.

(57) ABSTRACT

A sheet binding device binds a sheet bundle by causing a movable-crimping-member moving unit to move a movable crimping member thereby holding a sheet bundle between crimping members. The movable-crimping-member moving unit includes: a link mechanism that includes a first link member rotatably connected to the movable crimping member, a second link member rotatably connected to a fixed member fixed to a device body and connected to the first link member through a connecting part; a connecting member rotatably connected to the connecting part, and capable of moving between a first position causing the link mechanism to be extended and a second position causing the link mechanism to be more flexed than in the first position; and a connecting-member moving unit that includes a rotary member capable of rotating on a displaceable rotating shaft, and reciprocates the connecting member by rotation of the rotary member in one direction.

13 Claims, 18 Drawing Sheets

(51) Int. Cl.

| | |
|---|---|
| ***B42B 5/00*** | (2006.01) |
| ***B42C 1/12*** | (2006.01) |
| ***B65H 37/04*** | (2006.01) |
| ***G03G 15/00*** | (2006.01) |
| ***B65H 29/12*** | (2006.01) |
| ***B65H 29/14*** | (2006.01) |
| ***B65H 31/26*** | (2006.01) |
| ***B65H 31/30*** | (2006.01) |
| ***B65H 31/36*** | (2006.01) |
| ***B65H 9/00*** | (2006.01) |

(52) U.S. Cl.

CPC ..... *B65H 9/006* (2013.01); *B65H 29/125* (2013.01); *B65H 29/14* (2013.01); *B65H 31/26* (2013.01); *B65H 31/3027* (2013.01); *B65H 31/36* (2013.01); *B65H 37/04* (2013.01); *G03G 15/6544* (2013.01); *B31F 2201/0712* (2013.01); *B65H 2301/4212* (2013.01); *B65H 2301/4213* (2013.01); *B65H 2301/4214* (2013.01); *B65H 2301/43828* (2013.01); *B65H 2301/51616* (2013.01); *B65H 2403/942* (2013.01); *B65H 2801/27* (2013.01)

(56) References Cited

U.S. PATENT DOCUMENTS

| | | | | |
|---|---|---|---|---|
| 2005/0257910 | A1 | 11/2005 | Boatman et al. | |
| 2010/0194023 | A1 | 8/2010 | Ozawa et al. | |
| 2010/0202814 | A1 | 8/2010 | Nakamura | |
| 2013/0001848 | A1 | 1/2013 | Hidaka et al. | |
| 2013/0011219 | A1 | 1/2013 | Musha et al. | |
| 2013/0045065 | A1 * | 2/2013 | Ito | 412/16 |
| 2013/0154178 | A1 | 6/2013 | Suzuki et al. | |
| 2013/0264762 | A1 * | 10/2013 | Matsushita et al. | 270/58.08 |

FOREIGN PATENT DOCUMENTS

| | | | | |
|---|---|---|---|---|
| JP | 11-322170 | | | 11/1999 |
| JP | 4038101 | | | 11/2007 |
| JP | 2007-536141 | | | 12/2007 |
| JP | 2009-031489 | | | 2/2009 |
| JP | 2010-184769 | | | 8/2010 |
| JP | 2010-208854 | | | 9/2010 |
| JP | 2010-274623 | | | 12/2010 |
| JP | 2010274623 | A | * | 12/2010 |
| JP | 2011-201652 | | | 10/2011 |
| JP | 2011201698 | A | * | 10/2011 |
| WO | 2009-110298 | | | 9/2009 |

* cited by examiner

SHEET BINDING DEVICE, SHEET PROCESSING APPARATUS, IMAGE FORMING APPARATUS, IMAGE FORMING SYSTEM, AND SHEET BINDING METHOD

CROSS-REFERENCE TO RELATED APPLICATIONS

The present application claims priority to and incorporates by reference the entire contents of Japanese Patent Application No. 2013-018453 filed in Japan on Feb. 1, 2013.

BACKGROUND OF THE INVENTION

1. Field of the Invention

The present invention relates to a sheet binding device for binding sheets, a sheet processing apparatus, image forming apparatus, and image forming system including the sheet binding device, and a sheet binding method.

2. Description of the Related Art

Conventionally, there is known an image forming system including a sheet processing apparatus equipped with a sheet binding device that binds a bundle of sheets on which images have been formed by an image forming apparatus with a binding tool provided as a binding unit.

Japanese Patent Application Laid-open No. 2010-184769 has disclosed a binding tool for binding a bundle of sheets without using any metal staples in such a manner that the sheets are crimped by strongly engaging crimping teeth, which are a pair of crimping members having a toothing aligned in a predetermined direction, thereby entangling fibers of the sheets. The bundle of sheets is bound by crimping without using any metal staples; therefore, it is possible to avoid the trouble of having to remove metal staples from a sheet bundle when the sheet bundle is discarded or shredded.

The inventors of the present application have developed a sheet binding device that performs crimp binding of a sheet bundle by moving one of a pair of crimping teeth by means of a link mechanism and a crank mechanism, thereby pressing the sheet bundle with the pair of crimping teeth.

The sheet binding device has a pressing-force giving unit for giving a pressing force to press a sheet bundle inserted between the pair of crimping teeth, against the crimping tooth. This pressing-force giving unit includes a link mechanism that is connected to the lower crimping tooth and moves the lower crimping tooth in a vertical direction, a crank mechanism that operates the link mechanism, and a drive source that drives crank mechanism.

When the sheet binding device binds a sheet bundle, the crank mechanism is rotated by the drive source, thereby the link mechanism is extended, and the lower crimping tooth moves toward the upper crimping tooth. Accordingly, the sheet bundle is held between the upper and lower crimping teeth and pressed with the upper and lower crimping teeth; thus, crimp binding is performed on the sheet bundle.

In this sheet binding device, a rotating shaft of the crank mechanism is fixed to a device body; therefore, once a sheet bundle is held between the upper and lower crimping teeth, the link mechanism being in a flexed state is locked at the position. When the link mechanism is locked in this way, the crank mechanism cannot be rotated in the same direction anymore, so the crank mechanism is also locked.

Therefore, after the sheet bundle has been bound, the crank mechanism is rotated in a direction opposite to the rotation direction at the time of binding the sheet bundle to move the lower crimping tooth away from the upper crimping tooth so that the link mechanism and the crank mechanism are unlocked. Then, the lower crimping tooth is moved until the space between the upper and lower crimping teeth reaches a predetermined interval, and after that, the sheet bundle is taken out from between the crimping teeth.

However, the relative distance between the upper and lower crimping teeth when a sheet bundle is held between the upper and lower crimping teeth varies according to the thickness of the sheet bundle. Therefore, when the lower crimping tooth is moved until the space between the upper and lower crimping teeth reaches the predetermined interval after the sheet bundle has been bound, a rotation amount by which the crank mechanism is to be reversely rotated varies according to the thickness of the sheet bundle. Accordingly, it is necessary to acquire the thickness of a sheet bundle and perform control of reversely rotating the crank mechanism on the basis of a rotation amount preset according to the thickness of a sheet bundle and the acquired thickness of the sheet bundle, and there arises a problem that the control in binding becomes complicated.

Furthermore, the above-described problem occurs not only in the configuration in which the link mechanism is operated by the crank mechanism but also in a configuration in which the link mechanism is operated by a cam mechanism adopted instead of the crank mechanism.

In view of the above, there is a need to provide a sheet binding device, a sheet processing apparatus, image forming apparatus, and image forming system including the sheet binding device, and a sheet binding method capable of simplifying the control in binding regardless of the thickness of a sheet bundle.

SUMMARY OF THE INVENTION

It is an object of the present invention to at least partially solve the problems in the conventional technology.

A crimp-binding type of sheet binding device includes: a pair of toothing crimping members; and a movable-crimping-member moving unit that moves a movable crimping member which is one of the pair of crimping members and is movably installed. The sheet binding device binds a sheet bundle by causing the movable-crimping-member moving unit to move the movable crimping member thereby holding the sheet bundle between the pair of crimping members. The movable-crimping-member moving unit includes: a link mechanism that includes a first link member having one end rotatably connected to the movable crimping member, a second link member having one end rotatably connected to a fixed member fixed to a device body, and a connecting part that rotatably connects the other end of the first link member and the other end of the second link member; a connecting member having one end rotatably connected to the connecting part of the link mechanism, and capable of moving between a first position causing the link mechanism to be extended and a second position retracted from the first position and causing the link mechanism to be more flexed than in the first position; and a connecting-member moving unit that includes a rotary member capable of rotating on a displaceable rotating shaft, and reciprocates the connecting member between the first position and the second position by rotation of the rotary member in one direction.

A sheet binding method binds a sheet bundle by moving a movable crimping member which is one of a pair of toothing crimping members thereby holding the sheet bundle between the pair of crimping members. A connecting member having one end connected to a connecting part of a link mechanism, which includes a first link member having one end rotatably connected to the movable crimping member, a second link member having one end rotatably connected to a fixed member fixed to a device body, and the connecting part that rotatably connects the other end of the first link member and the other end of the second link member, is reciprocated between a first position causing the link mechanism to be extended and a second position retracted from the first position and causing the link mechanism to be more flexed than in the first position by rotation of a rotary member, which is capable of rotating on a displaceable rotating shaft, in one direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
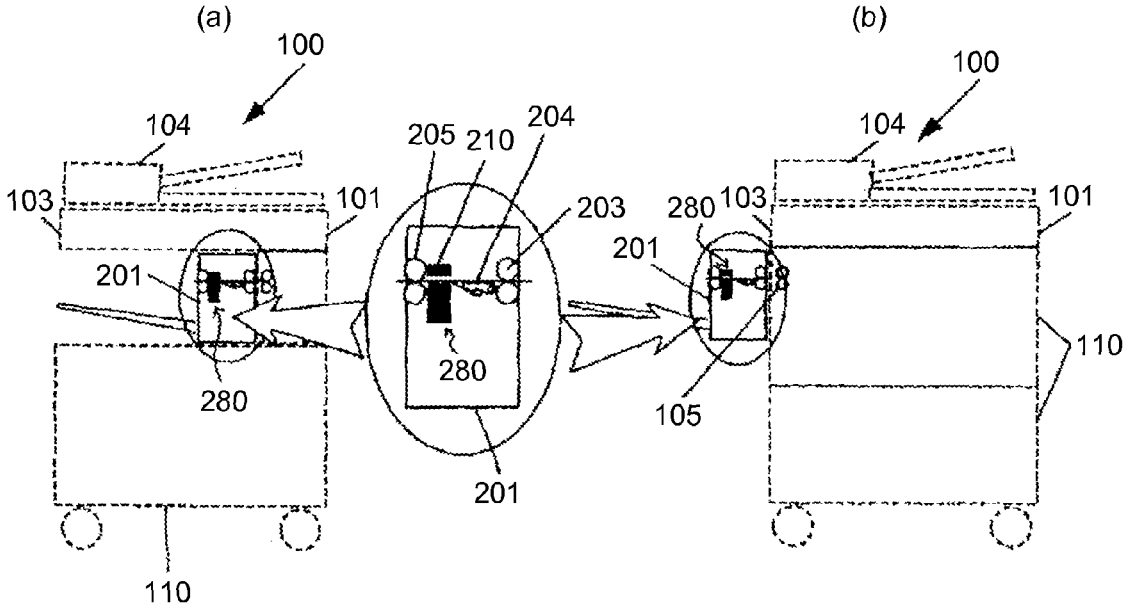
FIG. 2 is a diagram showing two forms of an image forming system according to an embodiment.

FIG. 2 is a diagram showing respective forms of an image forming apparatus and image forming system according to an embodiment. Namely, FIG. 2(*a*) shows an image forming apparatus 101 in which a sheet post-processing apparatus 201 as a sheet processing apparatus is installed in a conveyance path of the image forming apparatus 101. FIG. 2(*b*) shows an image forming system including the image forming apparatus 101 and the sheet post-processing apparatus 201 installed outside the conveyance path of the image forming apparatus 101.

The sheet post-processing apparatus 201 includes a crimp binding device 280 which is a sheet binding device for binding sheets discharged from the image forming apparatus 101. Furthermore, this sheet post-processing apparatus 201 has an alignment function of superposing sheets on top of another and aligning the sheets in the conveyance path and a binding function of binding a bundle of the aligned sheets in the conveyance path.

In FIG. 2(*a*), the sheet post-processing apparatus 201 performs post-processing inside the body of the image forming apparatus 101, and therefore is also called an in-body processing apparatus. The sheet post-processing apparatus 201 according to the present embodiment is compact, and can be easily installed or placed either inside the body or on the side surface of the image forming apparatus 101 depending on a form of the image forming apparatus 101.

The image forming apparatus 101 includes an image forming engine unit 110 including an image processing unit and a sheet feeding unit, a read engine unit 103 that reads an image and converts the read image into image data, and an automatic document feeder (ADF) 104 that automatically feeds an original to be read into the read engine unit 103. In FIG. 2(*a*), the discharge of a sheet on which an image has been formed is performed by a sheet discharge unit placed inside the body of the image forming apparatus 101; on the other hand, in FIG. 2(*b*), the discharge of a sheet on which an image has been formed is performed by the sheet discharge unit placed outside the image forming apparatus 101.

Figure 3:
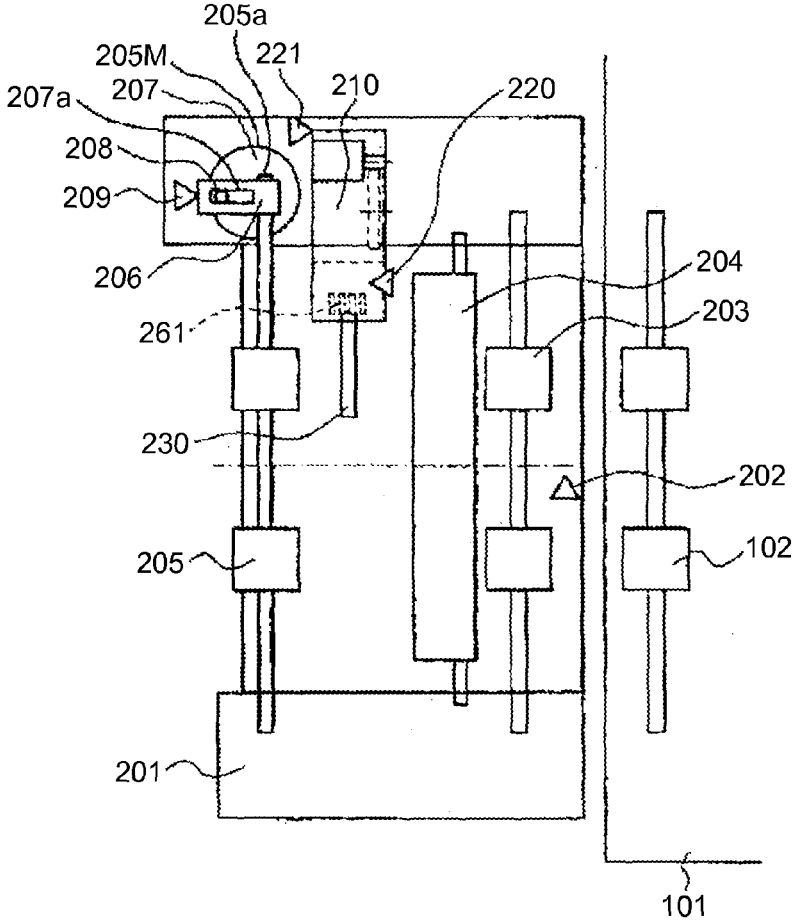
FIG. 3 is a plan view of a sheet post-processing apparatus shown in FIG. 2.
Figure 4:
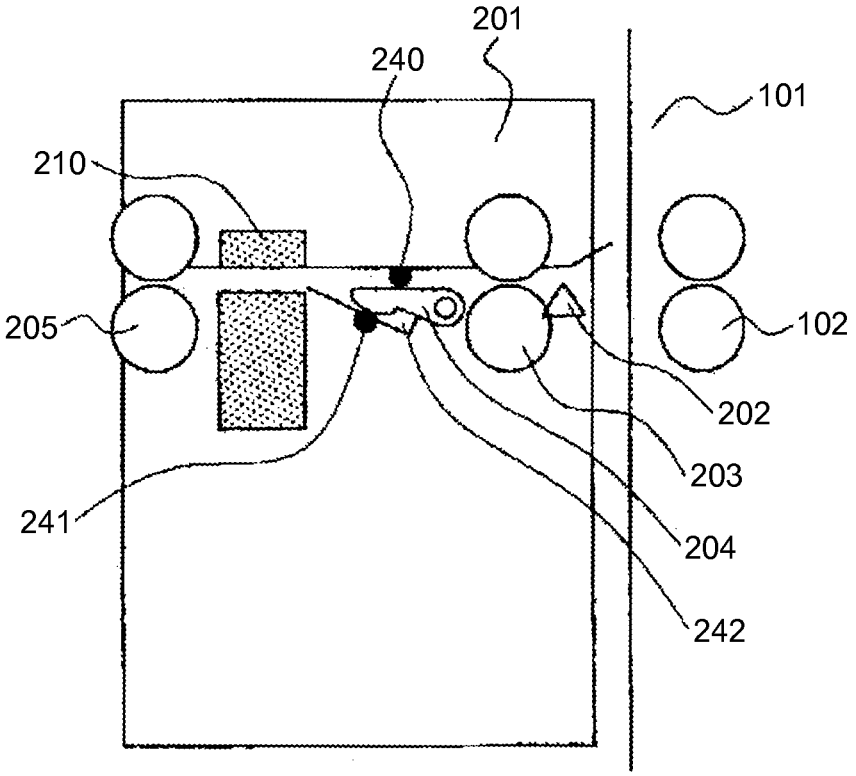
FIG. 4 is a front view of the sheet post-processing apparatus shown in FIG. 2.

FIG. 3 is a plan view of the sheet post-processing apparatus 201 shown in FIG. 2, and FIG. 4 is a front view of the sheet post-processing apparatus 201 shown in FIG. 2. In FIGS. 3 and 4, the sheet post-processing apparatus 201 includes an entrance sensor 202, an entrance roller 203, a bifurcating claw 204, a binding tool 210, and a sheet discharge roller 205 in order from the entrance along a conveyance path 240.

The entrance sensor 202 detects the leading and trailing ends of a sheet which has been discharged from a sheet discharge roller 102 of the image forming apparatus 101 and fed into the sheet post-processing apparatus 201, and also detects the presence or absence of the sheet. For example, a reflective optical sensor is used as the entrance sensor 202. Incidentally, instead of the reflective optical sensor, a transmission-type optical sensor can be also used.

The entrance roller 203 is located at the entrance of the sheet post-processing apparatus 201, and has a function of receiving a sheet discharged by the sheet discharge roller 102 of the image forming apparatus 101 and carrying the received sheet into the binding tool 210 which is a binding unit that the crimp binding device 280 has. A drive unit (a drive motor) (not shown) by which the stop or rotation of the entrance roller 203 and an amount of conveyance can be controlled and a post-processing control unit (not shown) for controlling this drive unit and the crimp binding device 280 and so on are also provided.

The entrance roller 203 also has a function of correcting skew of a sheet conveyed from the image forming apparatus 101 by bumping the leading end of the sheet into a nip between a pair of the entrance rollers 203.

The bifurcating claw 204 is placed in the subsequent stage of the entrance roller 203. The bifurcating claw 204 is installed to guide the trailing end of a sheet to a branch path 241. In this case, after the trailing end of a sheet has passed through the branch path 241, the bifurcating claw 204 rotates in a clockwise direction in FIG. 4, and thereby the sheet is conveyed in a direction opposite to the feed direction. Accordingly, the trailing end of the sheet is guided toward the branch path 241. As will be described later, the bifurcating claw 204 is driven to swing by a solenoid. Incidentally, the bifurcating claw 204 can be driven by a motor instead of the solenoid. When the bifurcating claw 204 is driven to rotate in a counterclockwise direction in FIG. 4, the bifurcating claw 204 can press a sheet or sheet bundle against a conveying surface of the branch path 241. Accordingly, the bifurcating claw 204 can immobilize the sheet or sheet bundle on the branch path 241.

The sheet discharge roller 205 is located just before the exit in the last stage of the conveyance path 240 of the sheet post-processing apparatus 201, and has functions of sheet conveyance, shift, and discharge. Furthermore, like the entrance roller 203, a drive source (a drive motor) by which the stop or rotation of the sheet discharge roller 205 and an amount of conveyance can be controlled is provided, and this drive source is controlled by the post-processing control unit. A shift of the sheet discharge roller 205 is performed by a shift mechanism 205M. The shift mechanism 205M is composed of a shift link 206, a shift cam 207, a shift cam stud 208, and a shift home position sensor 209.

The shift link 206 is installed on a shaft end 205*a* of the sheet discharge roller 205, and is subjected to a moving force of a shift. The shift cam 207 is a disc-like rotary part having the shift cam stud 208. In accordance with the rotation of this part, the sheet discharge roller 205 movably inserted into a shift link long hole part 207*a* via the shift cam stud 208 moves in a direction perpendicular to a sheet conveying direction. This movement is what is called a shift. The shift cam stud 208 has a function of converting rotation movement of the shift cam 207 into linear movement in an axial direction of the sheet discharge roller 205 in conjunction with the shift link long hole part 207*a*. The shift home position sensor 209 detects the position of the shift link 206; with the position detected by the shift home position sensor 209 as a home position, rotation control of the shift cam 207 is executed on the basis of this home position. This control is executed by the post-processing control unit.

The binding tool 210 includes a sheet-end detection sensor 220, a binding-tool home position sensor 221, and a guide rail 230 for movement of the binding tool. The binding tool 210 is a mechanism for binding a sheet bundle PB, and is what is called a stapler. In the present embodiment, the binding tool 210 has a function of binding sheets into a bundle by holding the sheets between a pair of tooth dies 261 and applying pressure to the sheets, thereby deforming the sheets and entangling fibers of the sheets. There are also known staplers using binding tools that bind a bundle of sheets in ways other than the above-described binding method, for example, by half blanking, by making slits and folding the slits, and by making slits and folding the slits and then putting the folded slits through a loop. In either case, the stapler contributes significantly to resource saving in that the stapler suppresses the consumption of supplies or makes supplies easy to recycle, and enables sheets to be directly put through a shredder. Therefore, by using the binding tool 210 like this, a sheet post-processing apparatus, i.e., a so-called finisher can perform binding sheets without using any metal staples, such as crimp binding.

The sheet-end detection sensor 220 is a sensor that detects the side edge of a sheet, and sheets are aligned on the basis of the position detected by this sensor. The binding-tool home position sensor 221 is a sensor that detects the position of the binding tool 210 which is movable in a sheet width direction, and detects a home position of the binding tool 210 where the binding tool 210 does not interfere with a sheet even if a maximum-sized sheet is conveyed. The guide rail 230 is a rail for guiding the movement of the binding tool 210 so that the binding tool 210 can stably move in the sheet width direction. The guide rail 230 is installed so that the binding tool 210 can move from the home position to the position capable of binding minimum-sized sheets in a direction perpendicular to a direction of conveying a sheet through the conveyance path 240 of the sheet post-processing apparatus 201. Incidentally, the binding tool 210 is driven to move along the guide rail 230 by a moving mechanism including a drive motor (not shown).

The conveyance path 240 is a conveyance path through which a received sheet is conveyed and discharged, and runs through the sheet post-processing apparatus 201 from the entrance to the exit. The branch path 241 is a conveyance path into which a sheet reversed backward (switched back) is fed from the trailing end side, and branches from the conveyance path 240. The branch path 241 is provided to superpose sheets on top of another and align the sheets thereon, and serves as an accumulating unit. A butting fence 242 is installed at the end of the branch path 241, and is a reference plane for aligning sheets by bumping the trailing end of the sheets thereinto. The tooth dies 261 are a pair of crimping members having dents and dings aligned in a predetermined direction, and are composed of an upper tooth die part 261*a* and a lower tooth die part 261*b* (see FIGS. 7A and 7B). The tooth dies 261 have a function of crimp-binding a sheet bundle PB by holding the sheet bundle PB between respective opposed tooth die surfaces of the upper and lower tooth die parts 261*a* and 261*b* and applying pressure to the sheet bundle PB.

Figure 5:
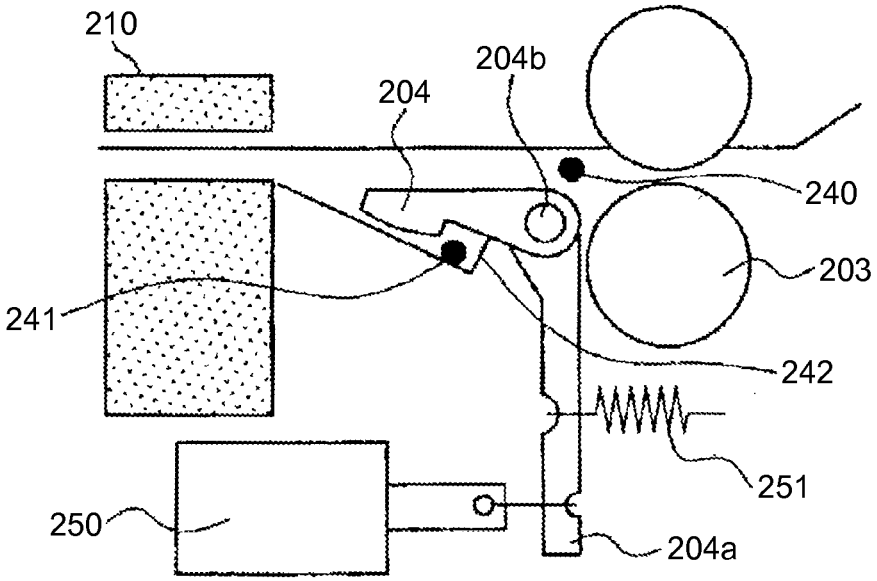
FIG. 5 is a diagram showing a main section of the sheet post-processing apparatus with a focus on a bifurcating claw shown in FIG. 4 when the bifurcating claw is in a sheet conveying state.
Figure 6:
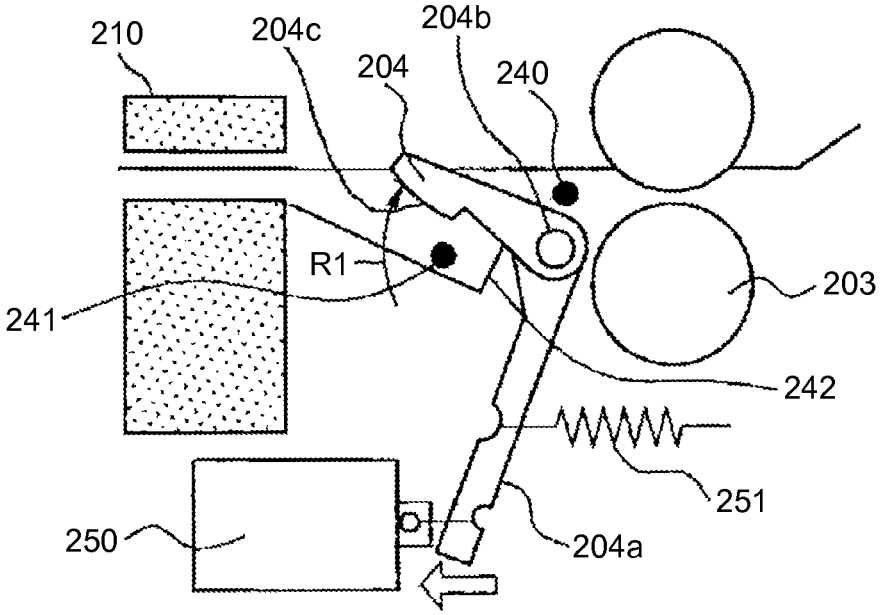
FIG. 6 a diagram showing the main section of the sheet post-processing apparatus with a focus on the bifurcating claw shown in FIG. 4 when the bifurcating claw switches back the sheet.

FIGS. 5 and 6 are diagrams showing a main section of the sheet post-processing apparatus 201 with a focus on the bifurcating claw 204. FIG. 5 shows details of associated mechanisms when the bifurcating claw 204 is in a sheet conveying state, and FIG. 6 shows details of associated mechanisms when a sheet is switched back. To switch a sheet conveyance path to either the conveyance path 240 or the branch path 241, the bifurcating claw 204 is swingably installed so that the bifurcating claw 204 can swing within a preset range of angles to a spindle 204*b*. The position of the bifurcating claw 204 enabling a sheet received from the right side in the diagrams to be conveyed downstream without resistance, i.e., the position of the bifurcating claw 204 shown in FIG. 5 is a home position, and the bifurcating claw 204 is elastically subjected to pressure in a counterclockwise direction constantly by a spring 251.

The spring 251 is hung on a bifurcating-claw movable lever part 204*a*, and a plunger of a bifurcating solenoid 250 is connected to the bifurcating-claw movable lever part 204*a*. Incidentally, after a sheet has been conveyed to the branch path 241 in a state shown in FIG. 6, when the bifurcating claw 204 goes into the state shown in FIG. 5, the sheet in the branch path 241 can be held between the conveying surface of the branch path 241 and the bifurcating claw 204. The conveyance path can be switched by turning the bifurcating solenoid 2500N/OFF. Namely, when the bifurcating solenoid 250 has been turned ON, the bifurcating claw 204 rotates in a direction of an arrow R1 shown in FIG. 6, thereby closing the conveyance path 240 and opening the branch path 241, so that a sheet can be led to the branch path 241.

FIGS. 7A to 15B are explanatory diagrams illustrating the operation of online binding performed by the binding tool 210 of the sheet post-processing apparatus 201. Incidentally, Figure A in each of the diagrams is a plan view, and Figure B is a front view.

In the present embodiment, the online binding unit that the sheet post-processing apparatus 201 is installed at a sheet discharge opening of the image forming apparatus 101 as shown in FIG. 2, and sheets on which images have been formed by the image forming apparatus 101 are sequentially fed into the sheet post-processing apparatus 201, and the sheet post-processing apparatus 201 aligns and binds the sheets into a bundle.

On the other hand, printouts output from the image forming apparatus 101 or printouts output from other apparatuses can be bound with the binding tool 210 of the sheet post-processing apparatus 201. This binding method is referred to as manual binding. The manual binding is not binding of sheets discharged from the image forming apparatus 101 through a sequence of actions, and therefore is included in offline binding.

Figure 7A:
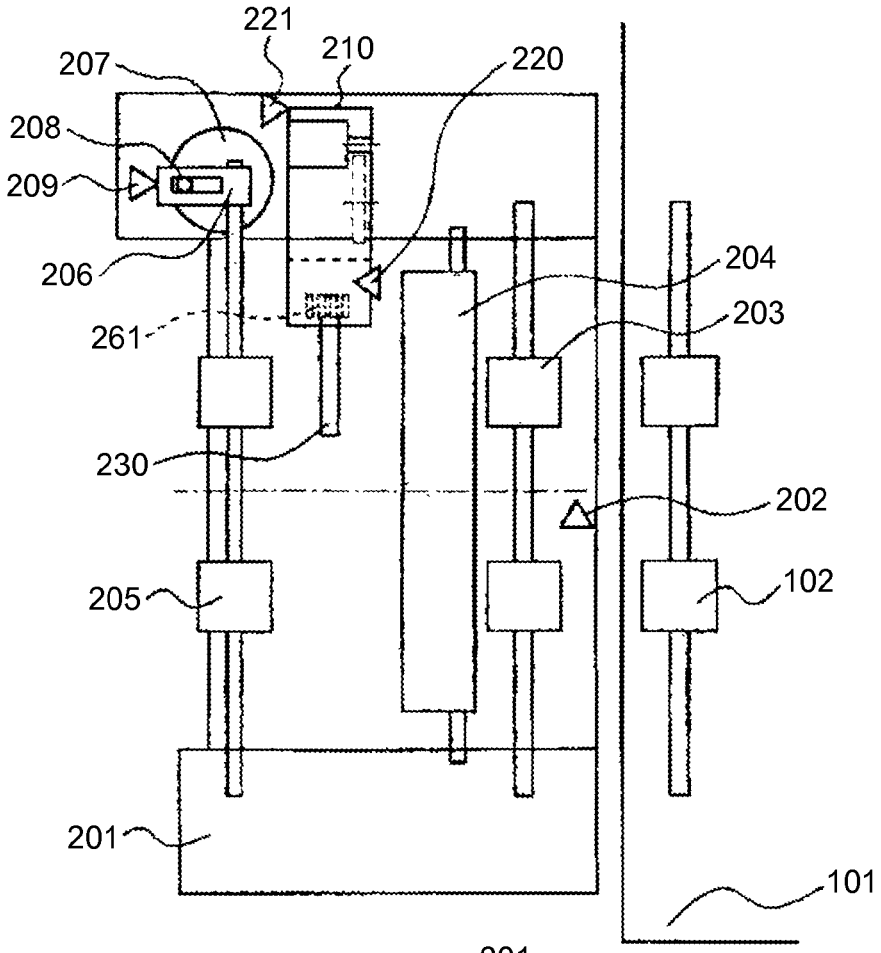
FIGS. 7A and 7B are operation explanatory diagrams showing a state of the sheet post-processing apparatus at the completion of an initial action of online binding operation.
Figure 7B:
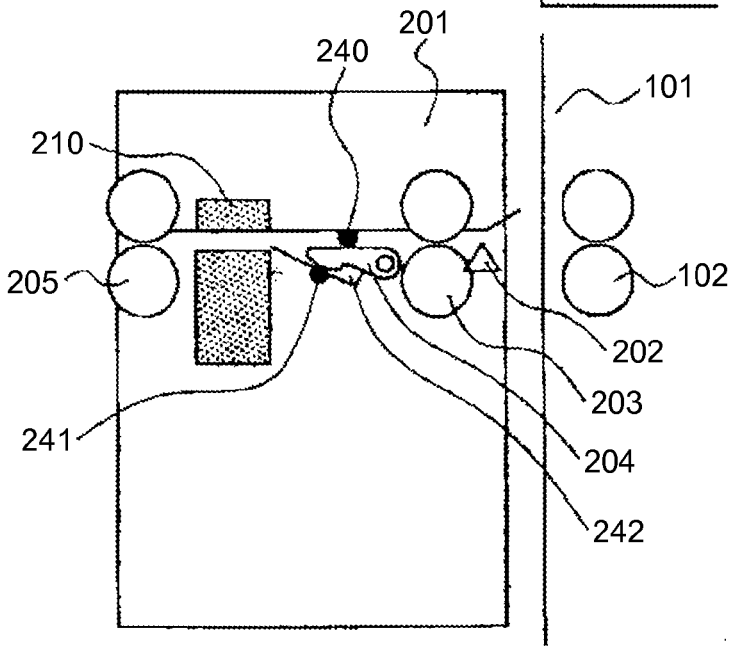

FIGS. 7A and 7B are diagrams showing a state of the sheet post-processing apparatus 201 at the completion of an initial action of the online binding operation. When the image forming apparatus 101 has started outputting sheets on which images have been formed, respective units move to their home positions and complete the initial process (action). FIGS. 7A and 7B illustrate a state of the sheet post-processing apparatus 201 at this time.

Figure 8A:
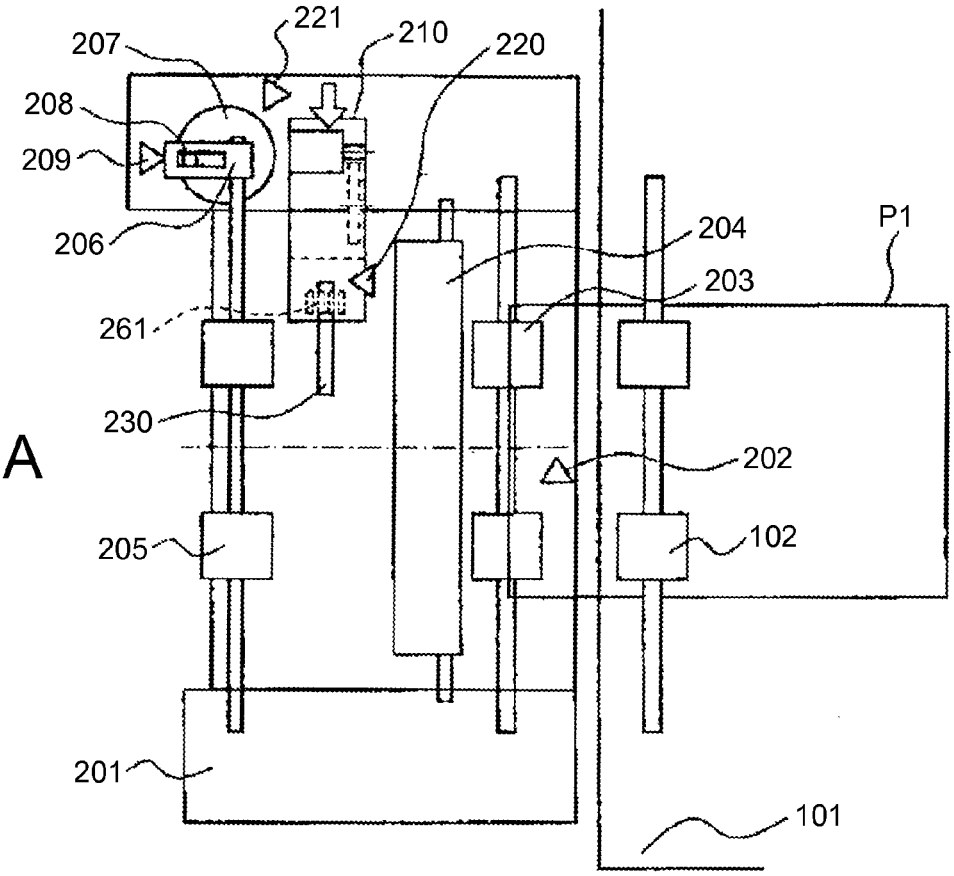
FIGS. 8A and 8B are operation explanatory diagrams showing a state of the sheet post-processing apparatus immediately after the first sheet has been discharged from an image forming apparatus and fed into the sheet post-processing apparatus from the state shown in FIGS. 7A and 7B.
Figure 8B:
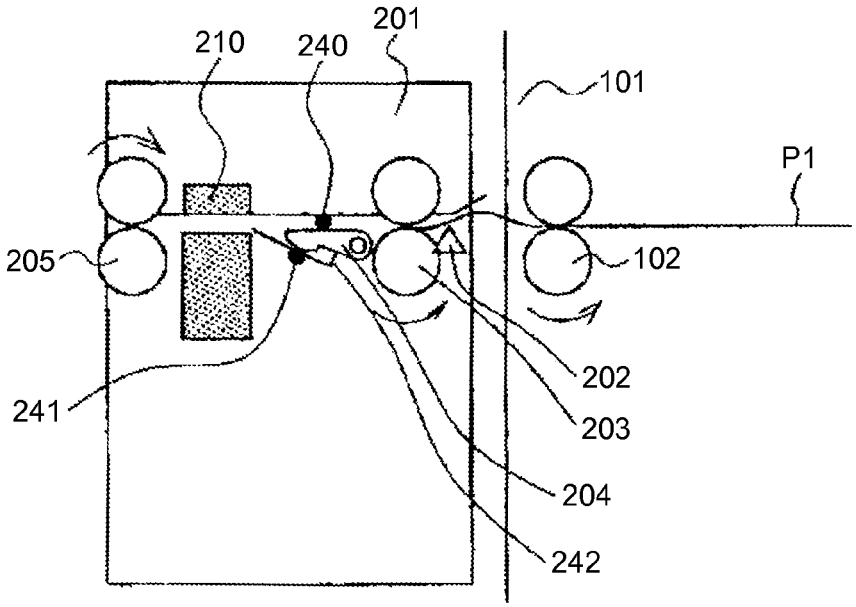

FIGS. 8A and 8B are diagrams showing a state of the sheet post-processing apparatus 201 immediately after the first sheet P1 has been discharged from the image forming apparatus 101 and fed into the sheet post-processing apparatus 201. Before the first sheet P1 from the image forming apparatus 101 is fed into the sheet post-processing apparatus 201, the post-processing control unit of the sheet post-processing apparatus 201 receives mode information on control mode for sheet post-processing and sheet information from a CPU (not shown) of the image forming apparatus 101. Then, the sheet post-processing apparatus 201 goes into a receiving waiting state on the basis of the received information.

There are three preset control modes: straight mode, shift mode, and binding mode. In the straight mode, when the sheet post-processing apparatus 201 has gone into the receiving waiting state, the entrance roller 203 and the sheet discharge roller 205 start rotating in the sheet conveying direction, and sheets P1, . . . , Pn are sequentially conveyed, and after the last sheet Pn is discharged from the image forming apparatus 101 and fed into the sheet post-processing apparatus 201, the entrance roller 203 and the sheet discharge roller 205 stop rotating. Incidentally, n is a positive integer more than one.

In the shift mode, when the sheet post-processing apparatus 201 has gone into the receiving waiting state, the entrance roller 203 and the sheet discharge roller 205 start rotating in the conveying direction. At the shift discharge action, when the sheet post-processing apparatus 201 has received and conveyed the first sheet P1, and the trailing end of the first sheet P1 has passed through the entrance roller 203, the shift cam 207 rotates by a predetermined rotation amount, and the sheet discharge roller 205 moves in an axial direction. At this time, the first sheet P1 also moves in accordance with the movement of the sheet discharge roller 205. Then, when the first sheet P1 has been discharged from the sheet post-processing apparatus 201, the shift cam 207 rotates and returns to its home position to wait for the next second sheet P2 to be fed into the sheet post-processing apparatus 201. This shift movement of the sheet discharge roller 205 is repeated until the nth (last) sheet Pn of a copy has been discharged from the sheet post-processing apparatus 201. Thus, a sheet bundle PB for one copy is discharged and stacked in a state where the sheet bundle PB is shifted to one side. When the first sheet P1 of the next copy is fed into the sheet post-processing apparatus 201, the shift cam 207 rotates in an opposite direction to that in the previous copy, and the sheet P1 moves toward the opposite side to that in the previous copy, and is discharged.

In the binding mode, when the sheet post-processing apparatus 201 has gone into the receiving waiting state, the entrance roller 203 is at a standstill, and the sheet discharge roller 205 starts rotating in the conveying direction. Furthermore, the binding tool 210 moves to a waiting position where the binding tool 210 is retracted by a predetermined amount from the sheet width, and waits for a sheet bundle to be set. In this case, the entrance roller 203 also serves as a registration roller. Namely, when the first sheet P1 has been fed into the sheet post-processing apparatus 201, the leading end of the sheet is detected by the entrance sensor 202 and then bumped into the nip between the entrance rollers 203. Then, due to the rotation of the sheet discharge roller 102 of the image forming apparatus 101, the first sheet P1 is conveyed further from the bumped position by a distance that causes the first sheet P1 a predetermined amount of deflection. After the first sheet P1 has been conveyed by the distance, the rotation of the entrance rollers 203 is started. This corrects skew of the first sheet P1. FIGS. 8A and 8B show a state at this time.

Figure 9A:
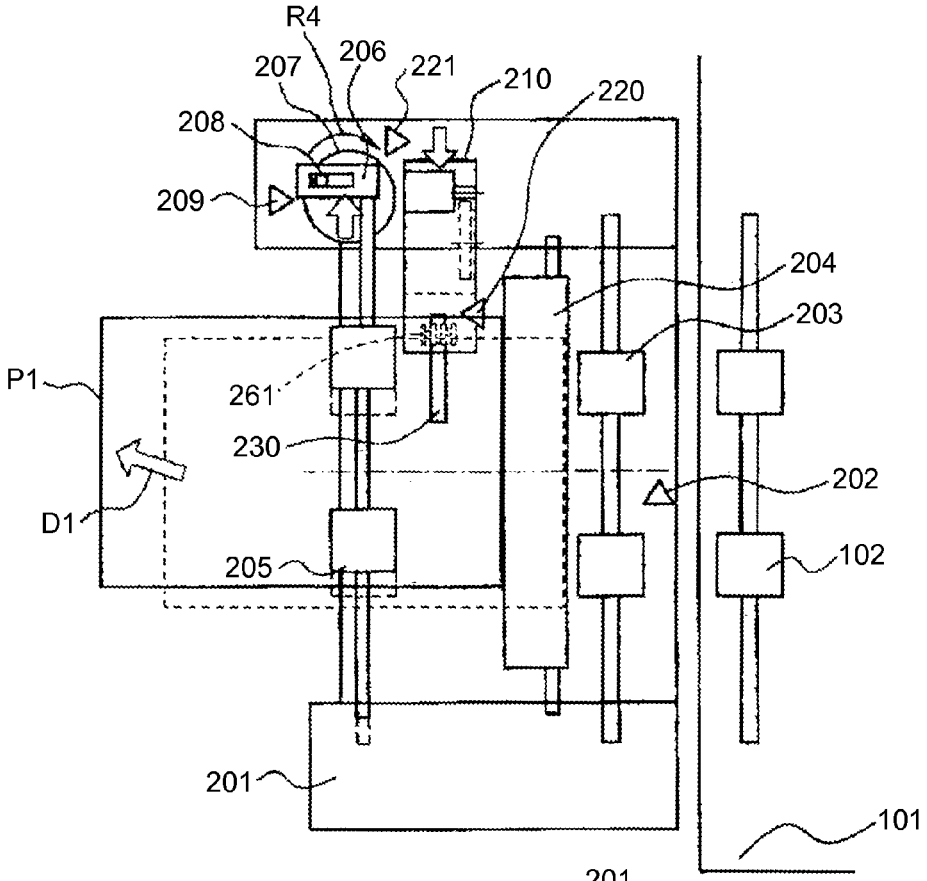
FIGS. 9A and 9B are operation explanatory diagrams showing a state of the sheet post-processing apparatus when the trailing end of the sheet has separated from a nip between entrance rollers and passed over a branch path from the state shown in FIGS. 8A and 8B.
Figure 9B:
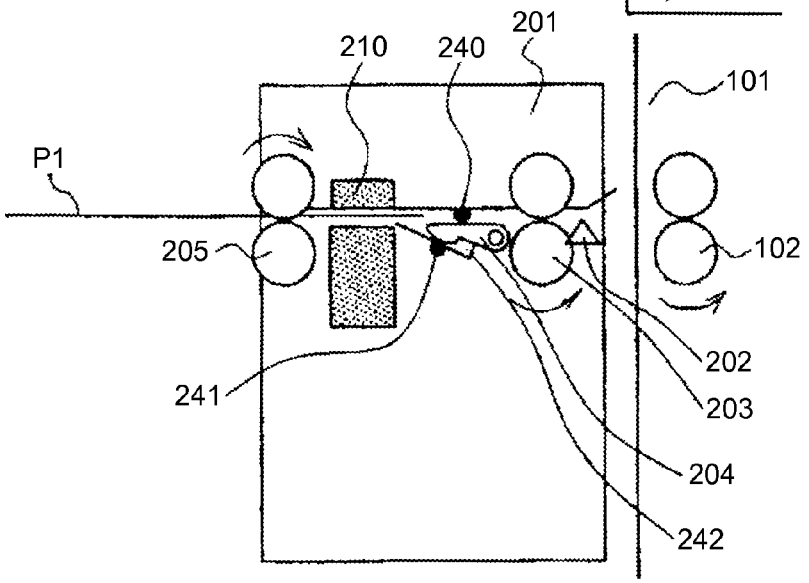

FIGS. 9A and 9B are diagrams showing a state of the sheet post-processing apparatus 201 when the trailing end of the sheet has separated from the nip between the entrance rollers 203 and passed over the branch path 241.

A conveyance amount of the first sheet P1 is counted on the basis of information on the trailing end of the sheet detected by the entrance sensor 202, and position information on the position of the sheet being conveyed is grasped by the post-processing control unit of the sheet post-processing apparatus 201.

When the trailing end of the sheet has passed through the nip between the entrance rollers 203, the entrance rollers 203 stop rotating to wait for the next second sheet P2 to be come. At the same time, the shift cam 207 rotates in a direction of an arrow R4 shown in FIG. 9A (a clockwise direction in FIG. 9A), and the sheet discharge roller 205 starts moving in the axial direction in a state where the sheet discharge roller 205 nips the first sheet P1. Accordingly, the first sheet P1 is conveyed obliquely in a direction of an arrow D1 shown in FIG. 9A. After that, when the sheet-end detection sensor 220 installed together with the binding tool 210 or incorporated in the binding tool 210 has detected the side edge of the sheet P1, the shift cam 207 stops rotating, and starts rotating in the opposite direction, and then stops rotating once the sheet-end detection sensor 220 does not detect the sheet P1. Then, after completion of the above actions, when the trailing end of the sheet P1 has passed through the tip of the bifurcating claw 204, the sheet discharge roller 205 stop rotating.

Figure 10A:
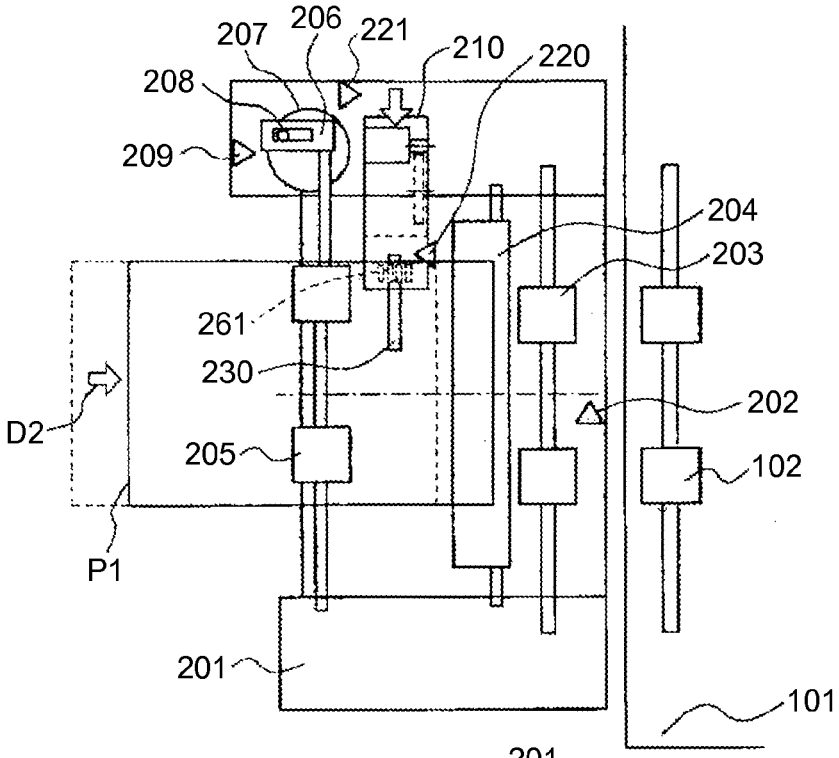
FIGS. 10A and 10B are operation explanatory diagrams showing a state of the sheet post-processing apparatus when the sheet is switched back to adjust a conveying direction of the sheet from the state shown in FIGS. 9A and 9B.
Figure 10B:
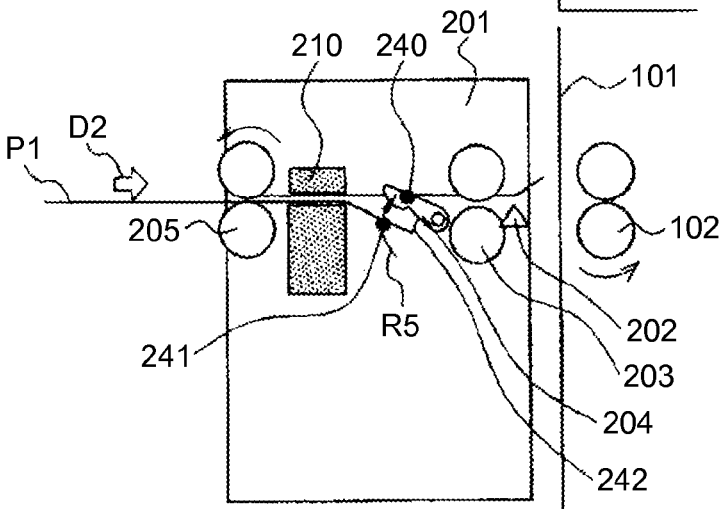

FIGS. 10A and 10B are diagrams showing a state of the sheet post-processing apparatus 201 when the sheet P1 is switched back to adjust the conveying direction of the sheet P1. After the conveyance path has been switched to the branch path 241 by rotating the bifurcating claw 204 in a direction of an arrow R5 shown in FIG. 10B from the state shown in FIGS. 9A and 9B, the sheet discharge roller 205 is rotated in the opposite direction. Accordingly, the first sheet P1 is switched back in a direction of an arrow D2, and the trailing end of the sheet P1 goes into the branch path 241 and is bumped into the butting fence 242. The trailing end of the sheet is aligned with reference to the butting fence 242 by the bumping.

When the first sheet P1 has been aligned, the sheet discharge roller 205 stops rotating. At this time, when the first sheet P1 has been bumped into the butting fence 242, the sheet discharge roller 205 is slipped so as not to apply a conveying force. Namely, when the first sheet P1 has been switched back and bumped into the butting fence 242, and the trailing end of the sheet has been aligned with reference to the butting fence 242, the sheet discharge roller 205 is configured not to convey the sheet anymore to prevent the sheet from buckling.

Figure 11A:
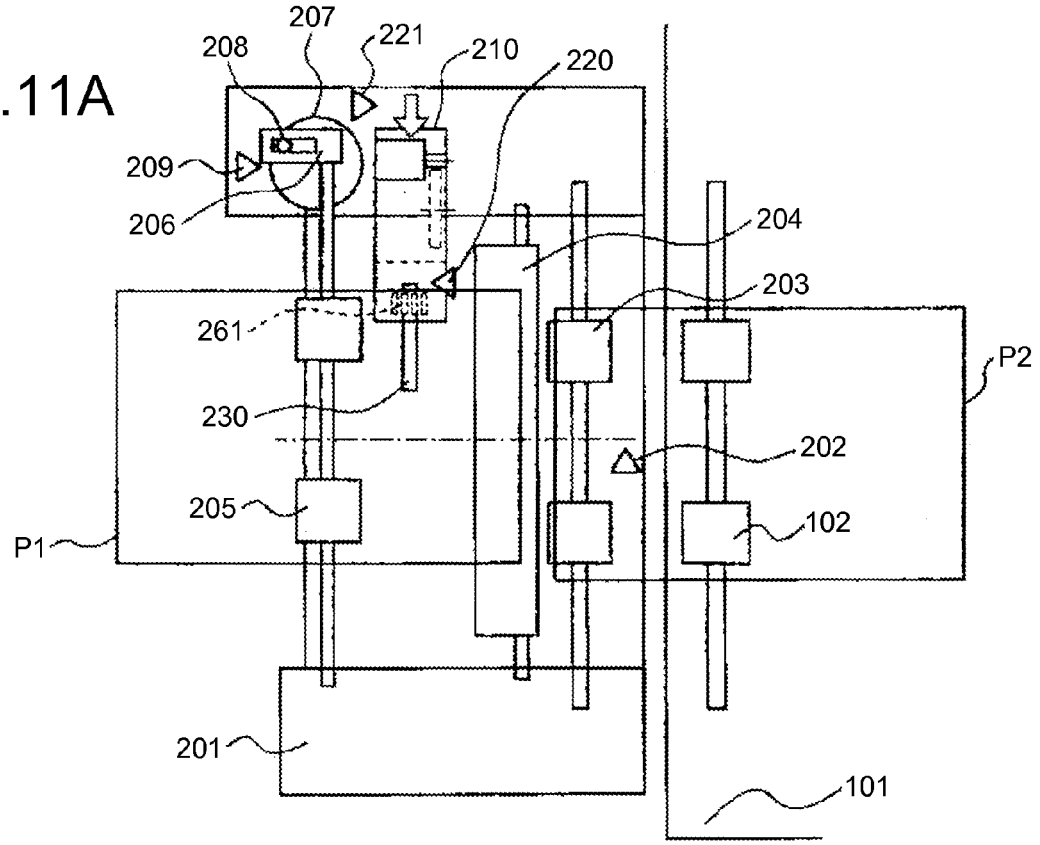
FIGS. 11A and 11B are operation explanatory diagrams showing a state of the sheet post-processing apparatus when the first sheet is kept waiting in the branch path from the state shown in FIGS. 10A and 10B, and the next second sheet is fed into the sheet post-processing apparatus.
Figure 11B:
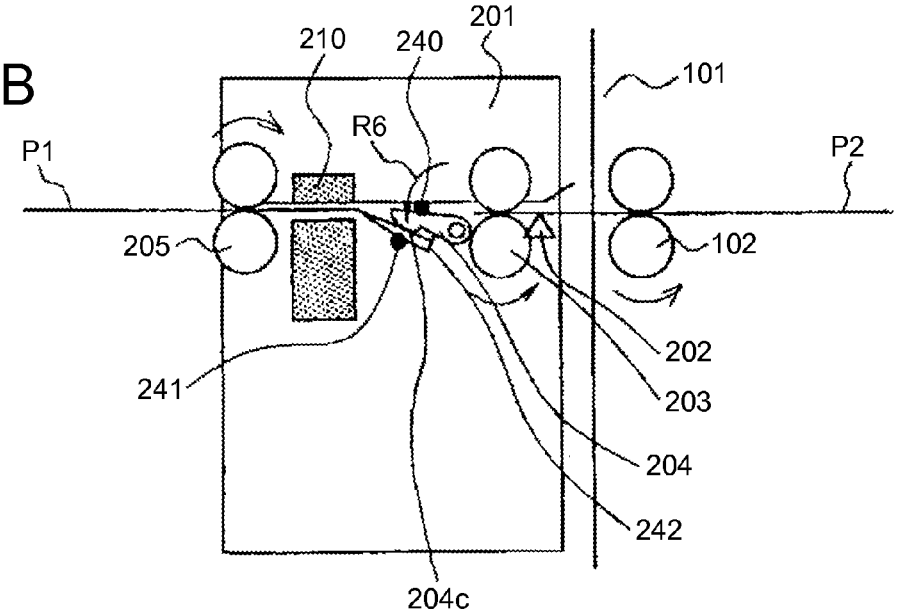

FIGS. 11A and 11B are diagrams showing a state of the sheet post-processing apparatus 201 when the first sheet P1 is kept waiting in the branch path 241, and the next second sheet P2 is fed into the sheet post-processing apparatus 201. After the preceding first sheet P1 has been aligned with reference to the butting fence 242, the bifurcating claw 204 is rotated in a direction of an arrow R6 shown in FIG. 11B. Accordingly, a contact surface 204*c*, which is the undersurface of the bifurcating claw 204, strongly presses the trailing end of the sheet located in the branch path 241 against the surface of the branch path 241 so as to keep the sheet P1 from moving. When the subsequent second sheet P2 has been fed from the image forming apparatus 101 into the sheet post-processing apparatus 201, skew of the second sheet P2 is corrected by the entrance roller 203 in the same manner as the preceding first sheet P1. Then, when the entrance roller 203 starts rotating, the sheet discharge roller 205 also starts rotating in the conveying direction at the same time.

Figure 12A:
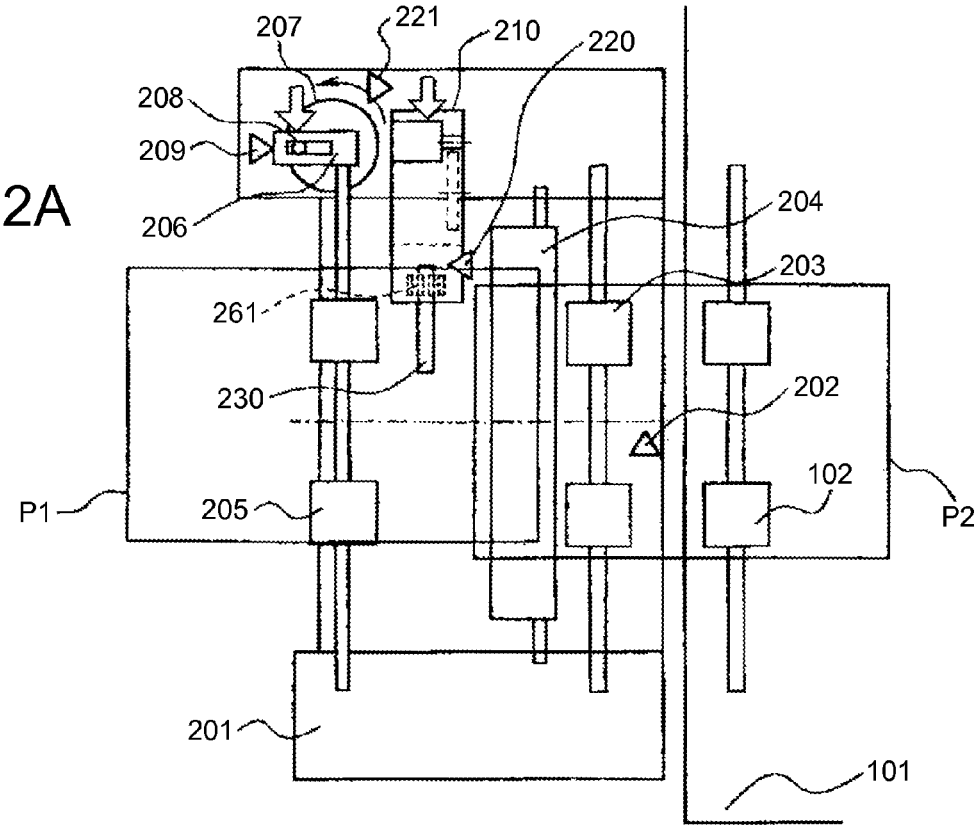
FIGS. 12A and 12B are operation explanatory diagrams showing a state of the sheet post-processing apparatus when the second sheet has been fed into the sheet post-processing apparatus from the state shown in FIGS. 11A and 11B.
Figure 12B:
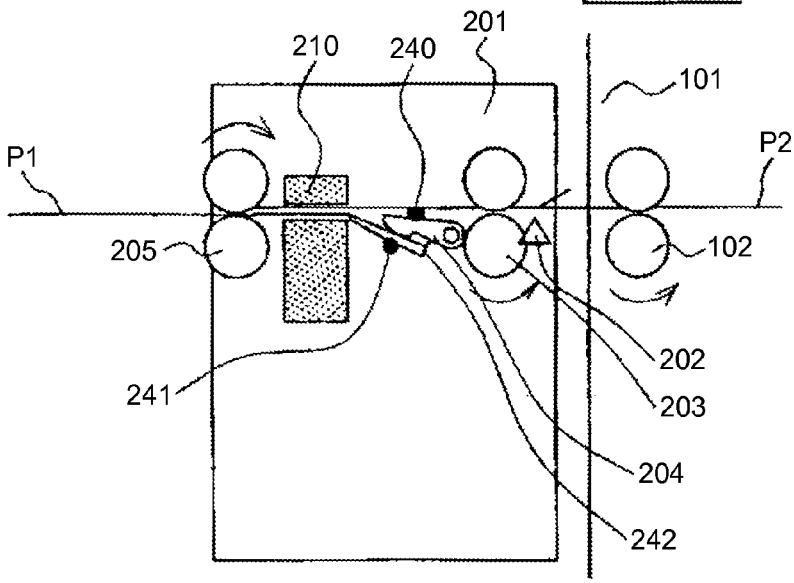

FIGS. 12A and 12B are diagrams showing a state of the sheet post-processing apparatus 201 when the second sheet P2 has been fed into the sheet post-processing apparatus 201. When the second sheet P2 and the third and subsequent sheets P3, . . . , Pn are conveyed from the state shown in FIGS. 11A and 11B, the actions illustrated in FIGS. 9A to 10B are executed in the same manner. Then, sheets sequentially fed from the image forming apparatus 101 are moved to a preset position, and superposed on top of another, and an aligned sheet bundle PB is stacked (piled up) in the conveyance path 240.

Figure 13A:
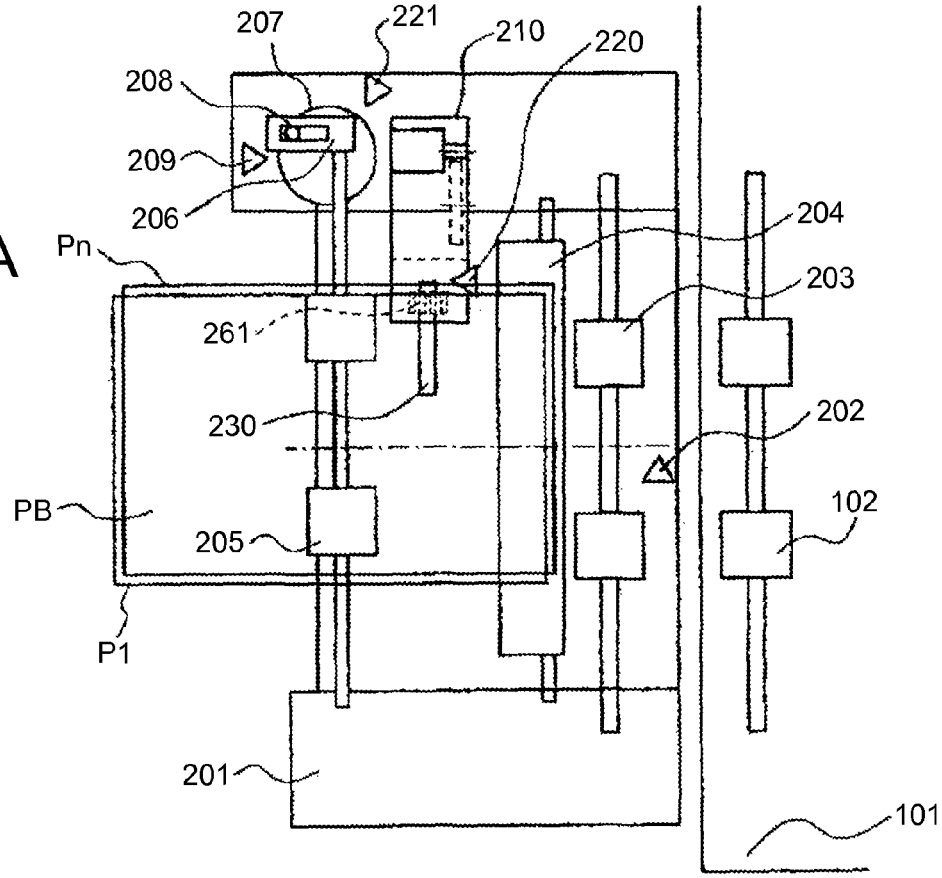
FIGS. 13A and 13B are operation explanatory diagrams showing a state of the sheet post-processing apparatus when the last sheet has been aligned, and a sheet bundle has been formed from the state shown in FIGS. 12A and 12B.
Figure 13B:
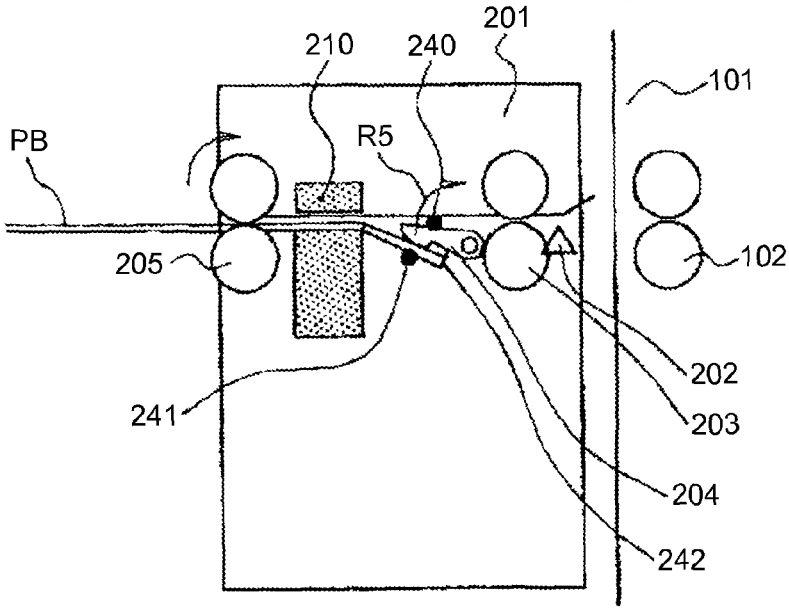

FIGS. 13A and 13B are diagrams showing a state of the sheet post-processing apparatus 201 when the last sheet Pn has been aligned, and a sheet bundle PB has been formed. After the sheet bundle PB has been aligned, the sheet discharge roller 205 is rotated by a predetermined rotation amount in the conveying direction, and is stopped. This action eliminates the deflection of the sheets generated when the trailing end of each sheet was bumped into the butting fence 242. After that, the bifurcating claw 204 is rotated in the direction of the arrow R5 shown in FIG. 13B, and the contact surface 204*c* is separated from the branch path 241, thereby releasing the pressure applied to the sheet bundle PB. Accordingly, the sheet bundle PB is released from a constraint force applied by the bifurcating claw 204, and can be conveyed by the sheet discharge roller 205.

Figure 14A:
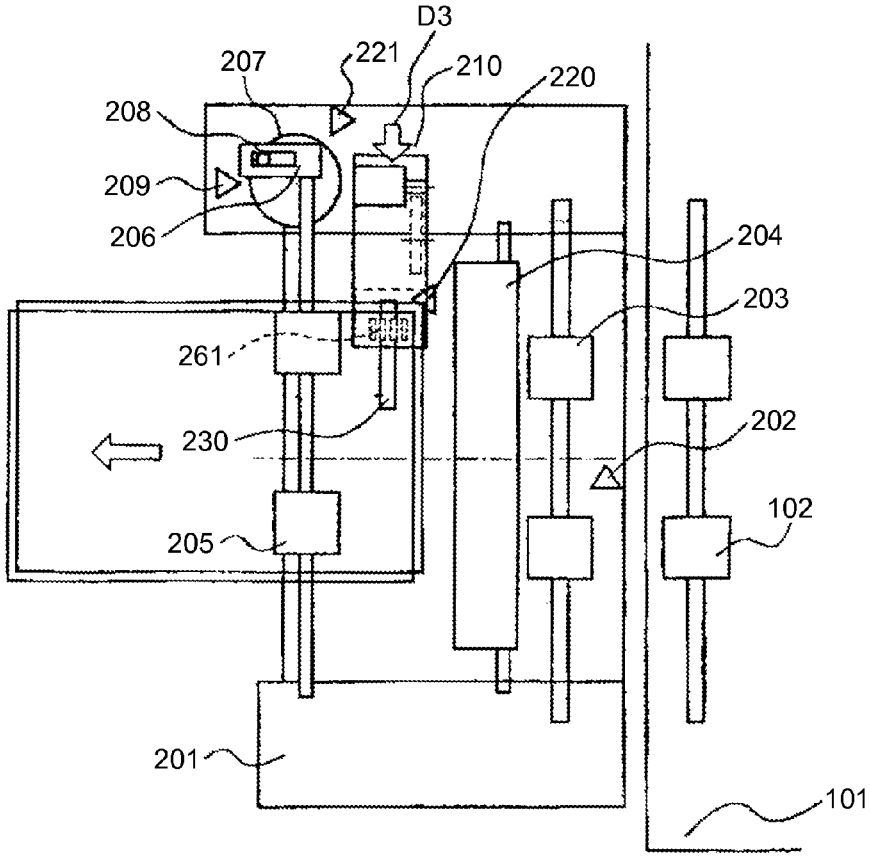
FIGS. 14A and 14B are operation explanatory diagrams showing a state of the sheet post-processing apparatus at the time of a binding action from the state shown in FIGS. 13A and 13B.
Figure 14B:
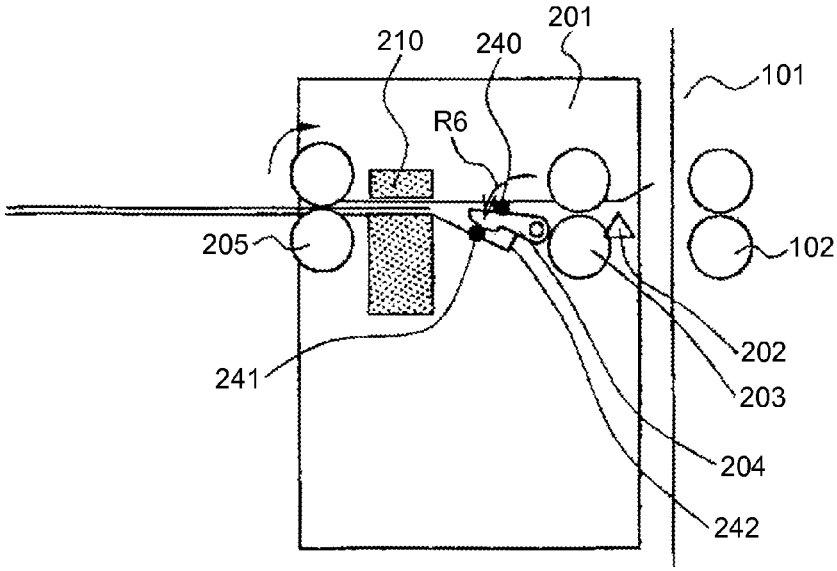

FIGS. 14A and 14B are diagram showing a state of the sheet post-processing apparatus 201 at the time of a binding action.

The sheet discharge roller 205 is rotated in the conveying direction from the state shown in FIGS. 13A and 13B, and the sheet bundle PB is conveyed by a distance that makes the position of the tooth dies 261 of the binding tool 210 fit with the binding position of the sheet bundle PB, and is stopped at the position. Accordingly, the processing position of the sheet bundle PB in the conveying direction coincides with the position of the tooth dies 261 in the conveying direction.

Then, the binding tool 210 is moved in a direction of an arrow D3 shown in FIGS. 14A and 14B by a distance that makes the position of the tooth dies 261 of the binding tool 210 fit with the processing position of the sheet bundle PB, and is stopped. Accordingly, the processing position of the sheet bundle PB in the width direction coincides with the position of the tooth dies 261 in both the conveying direction and the width direction. At this time, the bifurcating claw 204 is rotated in the direction of the arrow R6 shown in FIG. 14B, and goes back into the state of waiting for receiving a sheet.

After that, a drive motor 265 is turned ON, pressure is applied to the sheet bundle PB by the tooth dies 261, the sheet bundle PB is squeezed between the tooth dies 261, and thereby crimp binding is performed on the sheet bundle PB.

Figure 15A:
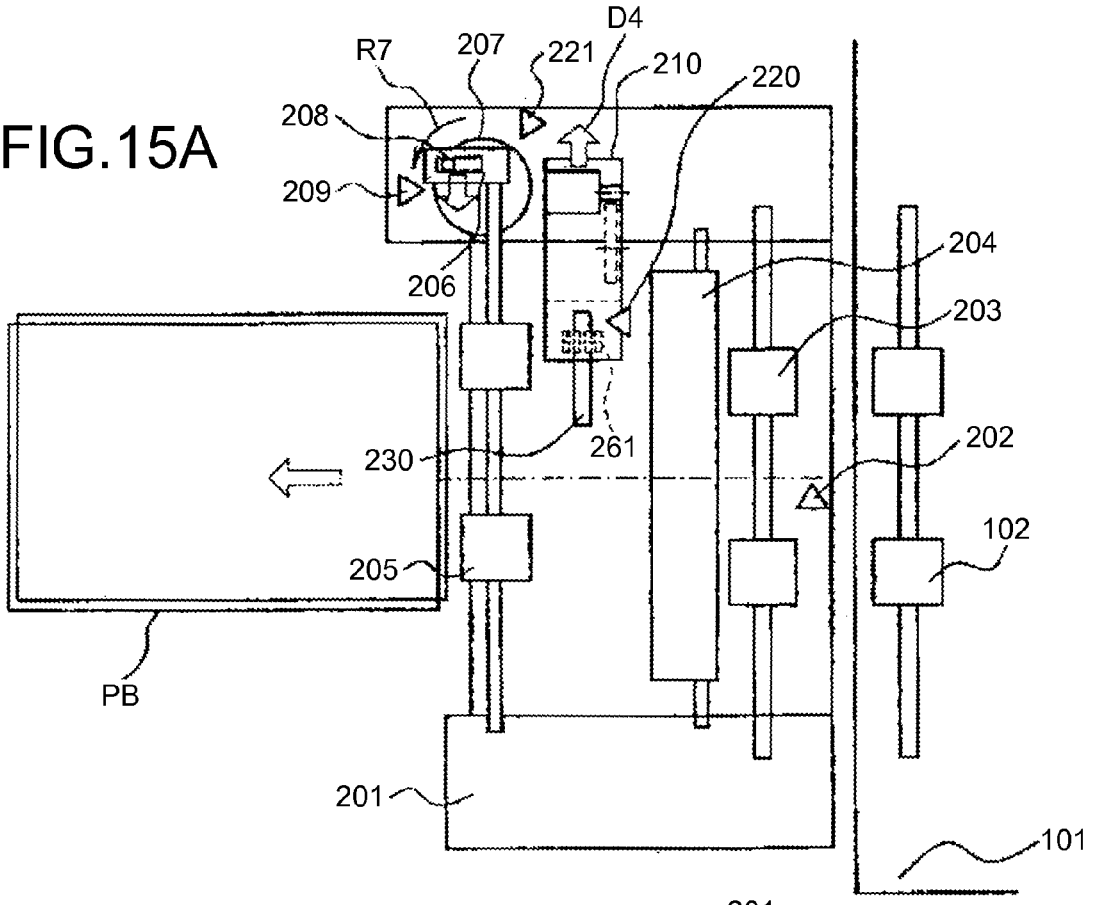
FIGS. 15A and 15B are operation explanatory diagrams showing a state of the sheet post-processing apparatus when the sheet bundle is discharged from the sheet post-processing apparatus from the state shown in FIGS. 14A and 14B.
Figure 15B:
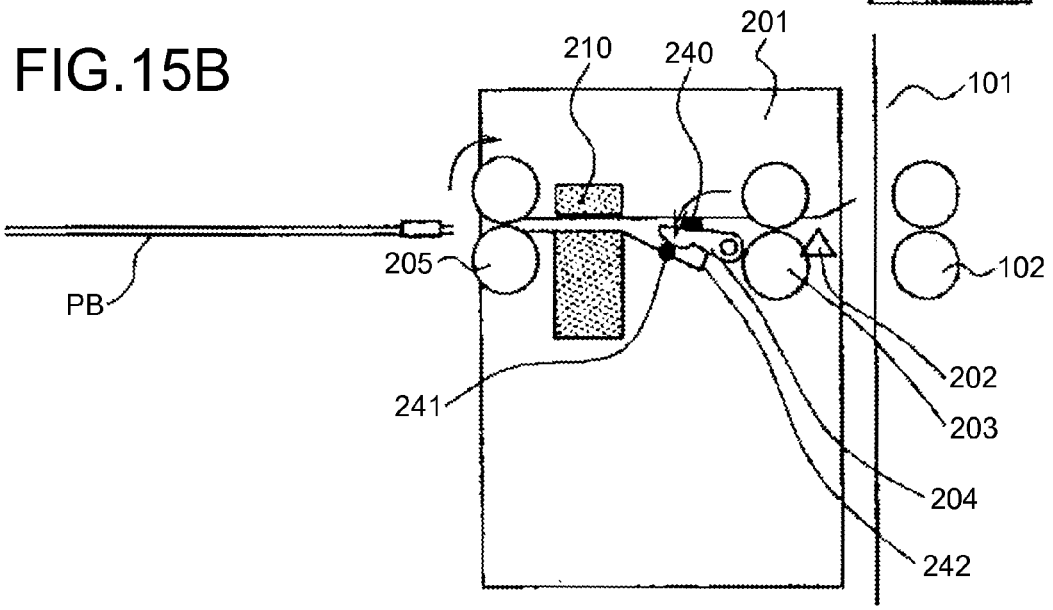

FIGS. 15A and 15B are diagrams showing a state of the sheet post-processing apparatus 201 when the sheet bundle PB is discharged from the sheet post-processing apparatus 201. The sheet bundle PB bound as shown in FIGS. 14A and 14B is discharged by the rotation of the sheet discharge roller 205. After the sheet bundle PB has been discharged, the shift cam 207 is rotated in a direction of an arrow R7 to return to its home position (the position shown in FIGS. 7A and 7B). In parallel with this, the binding tool 210 is moved in a direction of an arrow D4 shown in FIG. 15A to return to its home position (the position shown in FIGS. 7A and 7B). Accordingly, the binding operation of the sheet bundle PB for one copy has been completed. If there is the next copy, the actions shown in FIGS. 7A to 15B are repeated, and a crimp-bound sheet bundle PB for one copy is created in the same manner.

Figure 16:
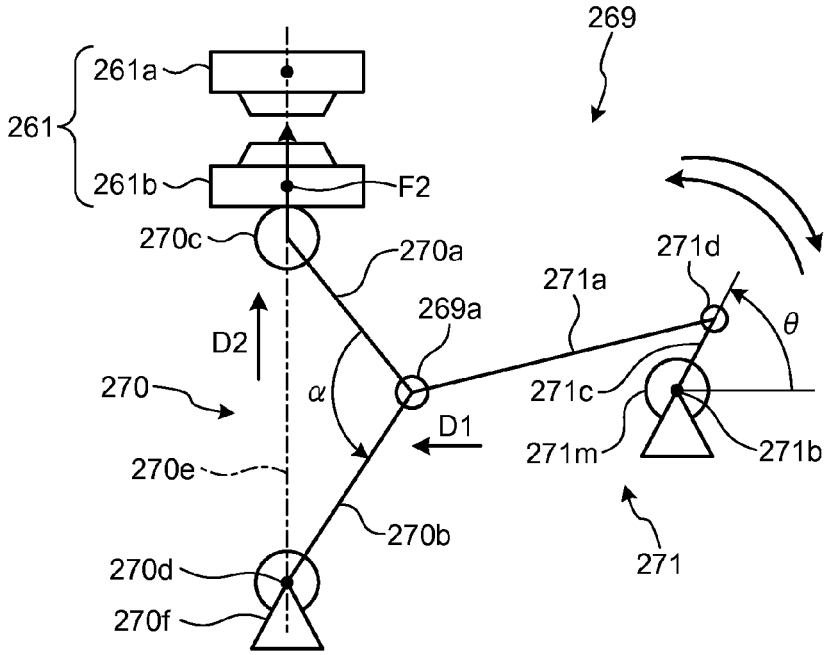
FIG. 16 is an explanatory diagram showing a squeeze crimping mechanism of a conventional sheet binding device.

FIG. 16 is an explanatory diagram showing a squeeze crimping mechanism 269 of a conventional crimp binding device 280.

The conventional crimp binding device 280 shown in FIG. 16 includes the squeeze crimping mechanism 269 as a pressing-force giving unit of giving the tooth dies 261*a* pressing force by moving the lower tooth die part 261*b*. This squeeze crimping mechanism 269 includes one link mechanism 270 and one crank mechanism 271 which operates the link mechanism 270 and so on. The link mechanism 270 and the crank mechanism 271 are rotatably connected by a first joint 269*a*.

The link mechanism 270 includes a first connecting rod 270*a* and a second connecting rod 270*b*. One end of the first connecting rod 270*a* and one end of the second connecting rod 270*b* are connected to the first joint 269*a*, and the other end of the first connecting rod 270*a* is rotatably connected to a second joint 270*c*, and the other end of the second connecting rod 270*b* is rotatably connected to a third joint 270*d*.

The second joint 270*c* is installed on the back side of the lower tooth die part 261*b*, and the third joint 270*d* is immovably installed on a fixed member 270*f* being an extension of the linear reciprocating movement of the lower tooth die part 261*b* (an extension of a virtual straight line 270*e*). This virtual straight line 270*e* corresponds to a course of the lower tooth die part 261*b* guided by a guide member (not shown) for guiding the lower tooth die part 261*b*.

The crank mechanism 271 includes a third connecting rod 271*a*, a drive motor 271*m*, a rotating shaft 271*b*, and a rotating rod 271*c* which is a plate-like member that is fixed to the rotating shaft 271*b* and rotates together with the rotating shaft 271*b*.

One end of the third connecting rod 271*a* is rotatably connected to the tip of the rotating rod 271*c* and a fourth joint 271*d*, and the other end is rotatably connected to the first joint 269*a*. Namely, one end of the first connecting rod 270*a*, one end of the second connecting rod 270*b*, and one end of the third connecting rod 271*a* are connected to the first joint 269*a*. Incidentally, the position of the rotating shaft 271*b* of the drive motor 271*m* is fixed.

Furthermore, the first connecting rod 270*a* and the second connecting rod 270*b* are connected at an angle enabling the first and second connecting rods 270*a* and 270*b* not to coincide with the virtual straight line 270*e* when the lower tooth die part 261*b* is maximally displaced toward the upper tooth die part 261*a*. In other words, the first connecting rod 270*a* and the second connecting rod 270*b* are connected at an angle enabling an angle α between the first and second connecting rods 270*a* and 270*b* across the first joint 269*a* not to become 180° (an angle enabling the first and second connecting rods 270*a* and 270*b* not to lie in a straight line). A link connected in such a state is also referred to as a "dogleg link".

The "dogleg link" unit a link mechanism including the first connecting rod 270*a*, the second connecting rod 270*b*, and the first joint 269*a*.

In this mechanism, the third connecting rod 271*a* is connected to the first joint 269*a*, and the first joint 269*a* is moved in a direction of an arrow D1 or a direction opposite to the arrow D1 by the rotating rod 271*c* driven by the drive motor 271*m*. At this time, the units of these mechanisms are arranged so that a dead point of the first joint 269*a* in the direction of the arrow D1 comes to a position just anterior to the virtual straight line 270*e*.

Accordingly, the first connecting rod 270*a* and the second connecting rod 270*b* never lie in a straight line, and the maximum pressing force can be given at the position where the first connecting rod 270*a* and the second connecting rod 270*b* lie almost in a straight line. In such a configuration, the first joint 269*a* constantly forms an apex angle, and forms sort of a dogleg shape, and therefore this link is referred to as a "dogleg link".

In the squeeze crimping mechanism 269 configured in this way, when the drive motor 271*m* rotates in a direction of an arrow θ shown in FIG. 16, the third connecting rod 271*a* presses the first joint 269*a* in the direction of the arrow D1 shown in FIG. 16, and the first joint 269*a* moves in the direction of the arrow D1. Then, the angle α between the first and second connecting rods 270*a* and 270*b* is increased.

On the other hand, the position of the third joint 270*d* is fixed, and therefore, the lower tooth die part 261*b* moves in a direction of an arrow D2 shown in FIG. 16 in accordance with the movement of the first joint 269*a*. Then, when the lower tooth die part 261*b* moves toward the upper tooth die part 261*a* while holding a sheet bundle PB inserted into a gap L, a pressing force is applied to the sheet bundle PB, thereby performing the crimping operation.

Incidentally, a reference numeral F2 denotes a point of action of the first connecting rod 270*a* on the lower tooth die part 261*b*, and is an extension of the virtual straight line 270*e*.

Such binding by a pressing-force giving mechanism includes a squeezing action as an action prior to a crimping action, and therefore is referred to as squeeze crimp binding as described above.

The link mechanism 270 is configured to displace the lower tooth die part 261*b*, and a unit to transmit a drive force to the link mechanism 270 is the crank mechanism 271.

The link mechanism 270 generates very strong power when the first and second connecting rods 270*a* and 270*b* are fully extended, and therefore is also used in an automotive jack. Therefore, when the link mechanism 270 is driven, a relationship between the two is set so that the maximum power can be generated at the timing when the crank mechanism 271 really wants power.

Figure 17:
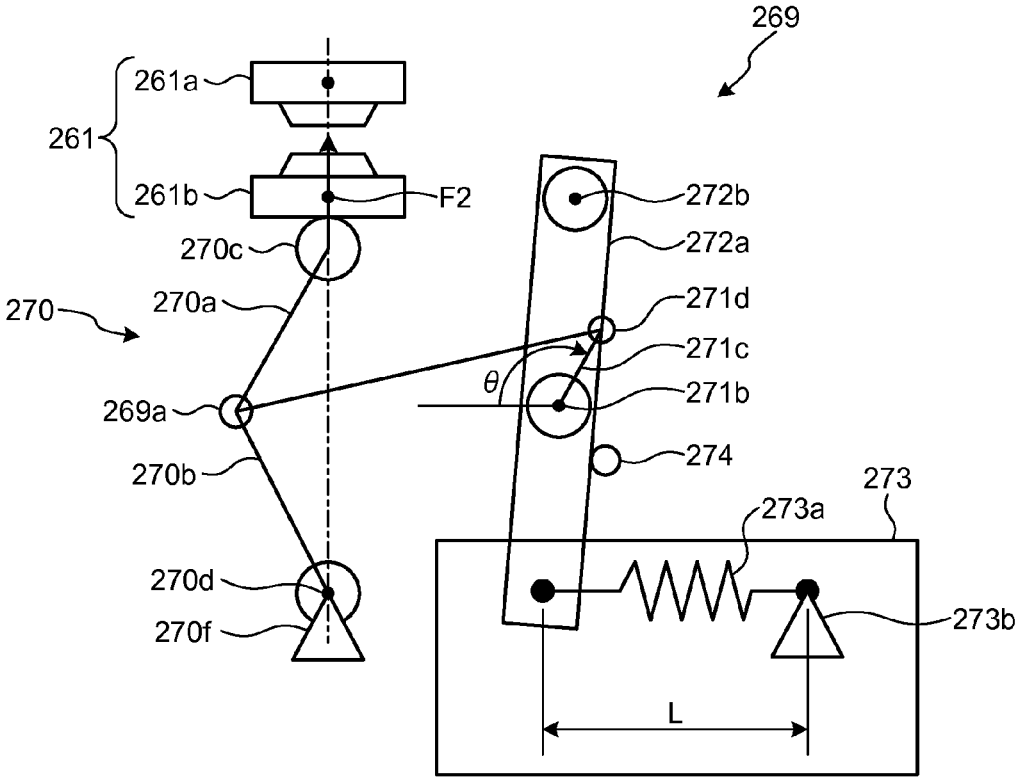
FIG. 17 is an explanatory diagram showing a squeeze crimping mechanism of a sheet binding device according to the embodiment.

FIG. 17 is an explanatory diagram showing a squeeze crimping mechanism 269 of the crimp binding device 280 according to the present embodiment.

The squeeze crimping mechanism 269 according to the present embodiment includes the link mechanism 270 and the crank mechanism 271 that the above-described conventional squeeze crimping mechanism 269 has; however, the rotating shaft 271*b* of the crank mechanism 271 is not fixed and is movable as shown in FIG. 17.

The rotating shaft 271*b* of the crank mechanism 271 is installed roughly on the center of a plate-like adjustment plate 272*a* having one end swingably supported by a supporting point 272*b*; when the adjustment plate 272*a* swings about the supporting point 272*b*, the rotating shaft 271*b* also moves.

As shown in FIG. 17, one end of a spring 273*a* of a load adjusting mechanism 273, which includes the spring 273*a* and a fixed member 273*b*, is attached to the other end of the adjustment plate 272*a*. The other end of the spring 273*a* is attached to the fixed member 273*b* fixed to the device body, and the spring 273*a* expands and contracts in accordance with the swinging of the adjustment plate 272*a*.

The squeeze crimping mechanism 269 according to the present embodiment is adjusted such that the distance between tooth die parts becomes 0 [mm], and applied pressure generated between the tooth die parts becomes 0 [N] when θ=180[°] is satisfied, i.e., when the crank mechanism 271 pulls the link mechanism 270 to the maximum extent in a state where there is no sheet bundle between the tooth die parts. Namely, at this time, the upper tooth die part 261*a* and the lower tooth die part 261*b* are merely in a contact state.

If the rotating shaft 271*b* of the crank mechanism 271 is fixed like the conventional squeeze crimping mechanism 269 shown in FIG. 16, once a sheet bundle PB is held between the upper tooth die part 261*a* and the lower tooth die part 261*b*, the link mechanism 270 being in a flexed state is locked at the position. Therefore, the crank mechanism 271 cannot be rotated.

Accordingly, it is necessary to obtain thickness information on the thickness of a sheet bundle PB and perform control of binding the sheet bundle PB by application of appropriate pressure when the crank mechanism 271 is locked. Furthermore, after the sheet bundle PB has been bound, the distance between the tooth die parts has to be increased by rotating the drive motor 271*m* in a direction opposite to the rotation direction at the time of binding the sheet bundle PB to take out the sheet bundle PB.

Figure 1A:
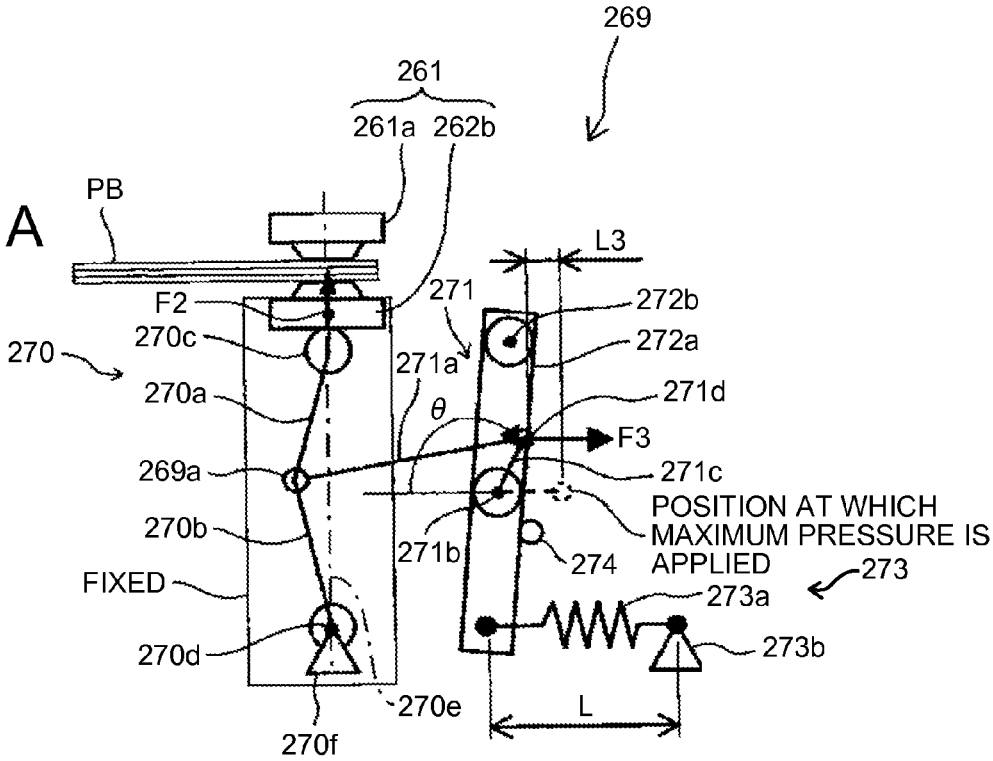
FIG. 1A is a diagram explaining the lock on a link mechanism.
Figure 1B:
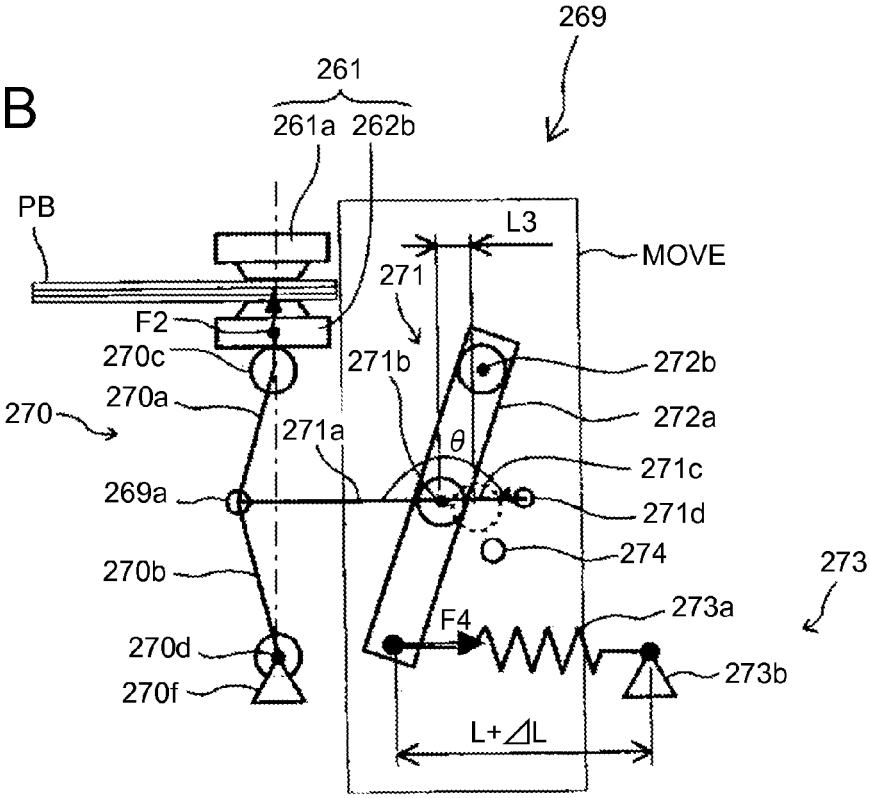
FIG. 1B is a diagram explaining the maximum applied pressure.

FIG. 1A is a diagram explaining the lock on the link mechanism 270, and FIG. 1B is a diagram explaining the maximum applied pressure.

As shown in FIG. 1A, in the crank mechanism 271 according to the present embodiment, when a sheet bundle PB has come between the upper tooth die part 261*a* and the lower tooth die part 261*b*, and the crank mechanism 271 has been locked, there still remains a distance L3 in a horizontal direction to the position at which the maximum pressure is originally applied.

Therefore, as shown in FIG. 1B, the configuration is such that the adjustment plate 272*a* swings toward the link mechanism 270, and when the angle θ becomes 180° at which a pulling force of the crank mechanism 271 to pull the link mechanism 270 reaches the maximum, the rotating shaft 271*b* moves toward the link mechanism 270 by the distance L3 in the horizontal direction. Consequently, without being locked, the crank mechanism 271 can rotate one revolution in one direction, and operate the link mechanism 270 so as to increase the degree of flexure, thereby being able to increase the distance between the tooth die parts.

Accordingly, it is not necessary to perform control of rotating the drive motor 271*m* in the opposite direction thereby rotating the crank mechanism 271 in a direction opposite to that at the time of binding the sheet bundle PB in order to increase the distance between the tooth die parts so that the sheet bundle PB can be taken out from between the tooth die parts after the sheet bundle PB has been bound. Therefore, it is possible to simplify the control in binding. Incidentally, the distance L3 is determined by the thickness of the sheet bundle PB.

Furthermore, at this time, depending on a moving distance of the adjustment plate 272*a* in the horizontal direction, a pulling force F4 to pull the adjustment plate 272*a* is produced in the spring 273*a* of the load adjusting mechanism 273, and the force can be transmitted to the lower tooth die part 261*b*.

Figure 18:
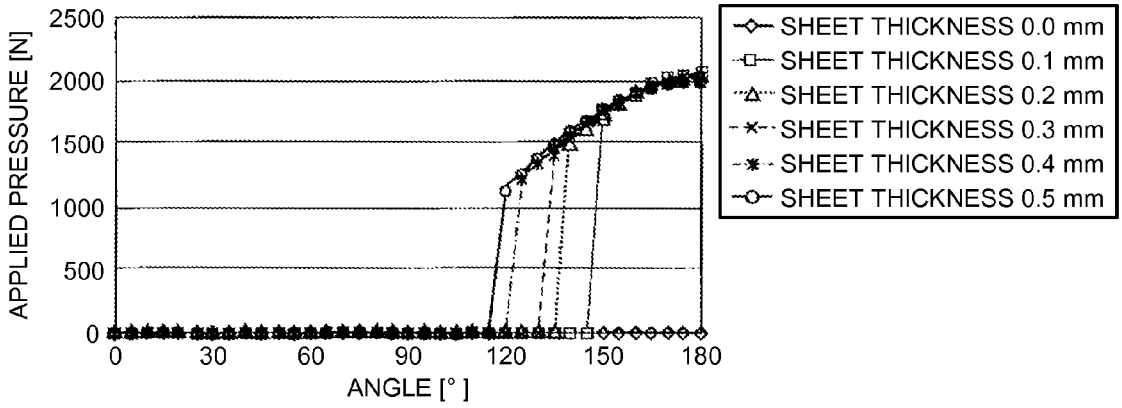
FIG. 18 is a graph showing applied pressure with respect to each sheet thickness.

FIG. 18 is a graph showing a relationship of applied pressure with each of sheet bundles PB that have the same number of sheets but differ in thickness of the sheets.

As shown in FIG. 18, the spring 273*a* having a spring constant that can make the maximum applied pressure constant regardless of the thickness of a sheet bundle PB is installed in the load adjusting mechanism 273. Accordingly, by rotating the crank mechanism 271 so as to satisfy θ=180 [°], constant pressure can be applied to a sheet bundle PB by the upper tooth die part 261*a* and the lower tooth die part 261*b* regardless of the thickness of the sheet bundle PB.

Alternatively, by increasing the spring constant of the spring 273*a*, the configuration may be made such that the pressure generated between the upper tooth die part 261*a* and the lower tooth die part 261*b* is greater and the maximum applied pressure is greater as thickness of a sheet bundle PB is greater.

Moreover, the pulling force F4 of the load adjusting mechanism 273 is produced when the adjustment plate 272*a* swings toward the link mechanism 270 and separates from a stopper 274. Through the adjustment described above, the applied pressure is 0 [N] in a state where there is no sheet bundle PB between the tooth die parts; therefore, it is possible to suppress damage to the tooth die parts in the event of idle binding (binding is performed even though no sheet bundle PB is held between the tooth die parts, and the upper tooth die part 261*a* and the lower tooth die part 261*b* are brought into direct contact).

Incidentally, in FIG. 17, the link mechanism 270 is configured to be operated by the crank mechanism 271; however, it is not limited to this. For example, as shown in FIGS. 19A and 19B, a cam mechanism 277 including a connecting member 275 and an eccentric cam 276 can be adopted instead of the crank mechanism 271, and the link mechanism 270 can be operated by the cam mechanism 277.

Figure 19A:
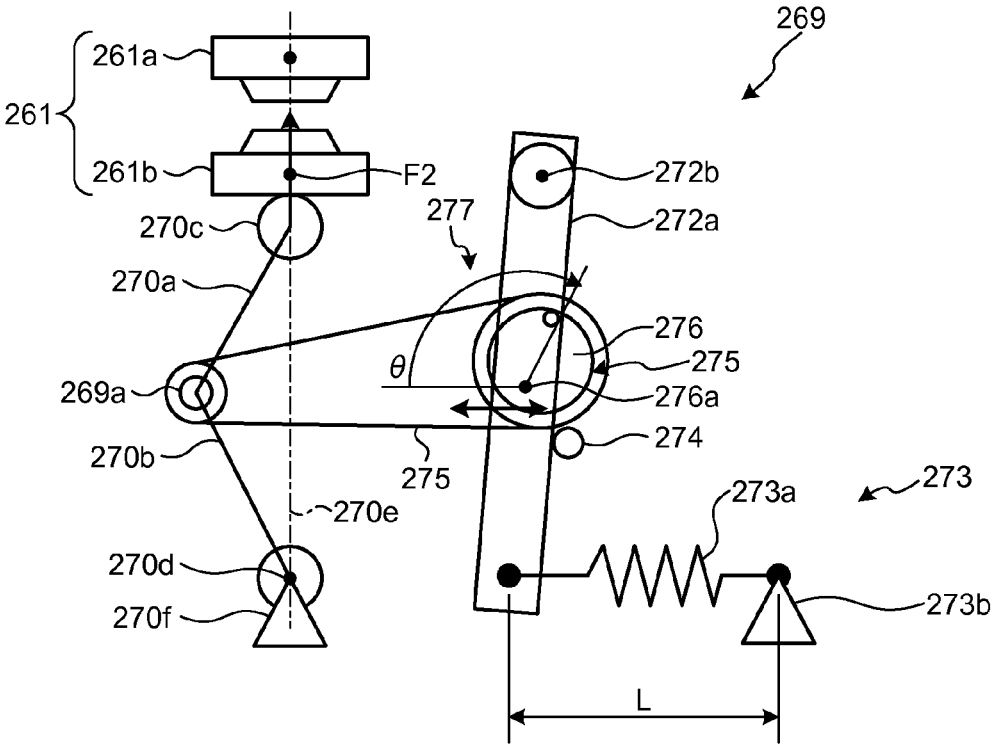
FIGS. 19A and 19B are explanatory diagrams showing a pressing-force giving unit that causes a cam mechanism to drive the link mechanism.
Figure 19B:
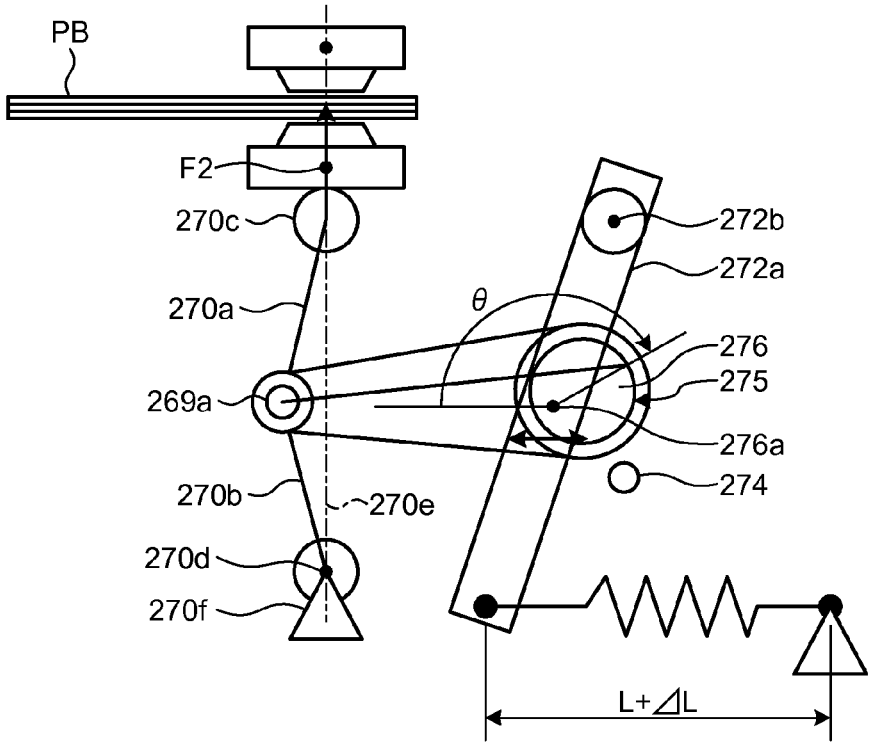

One end of the connecting member 275 of the cam mechanism 277 shown in FIG. 19A is rotatable connected to the first joint 269*a* of the link mechanism 270, and a cam insertion hole 275*a* into which the eccentric cam 276 is inserted is formed at the other end. The eccentric cam 276 is capable of rotating on an eccentrically-provided rotating shaft 276*a* within the cam insertion hole 275*a*. The rotating shaft 276*a* of the eccentric cam 276 is installed roughly on the center of the plate-like adjustment plate 272*a* having one end swingably supported by the supporting point 272*b*; when the adjustment plate 272*a* swings about the supporting point 272*b*, the rotating shaft 271*b* also moves.

Incidentally, except for the cam mechanism 277, a basic configuration of this squeeze crimping mechanism is identical to that of the squeeze crimping mechanism 269 including the link mechanism 270, so description of the other components is omitted.

When the eccentric cam 276 is rotated within the cam insertion hole 275*a*, an inner wall surface of the cam insertion hole 275*a* is pressed with a peripheral surface of the eccentric cam 276, and thereby the connecting member 275 is displaced and pushes or pulls the first joint 269*a* of the link mechanism 270. Accordingly, the link mechanism 270 can be operated to be extended or flexed by the cam mechanism 277.

When a sheet bundle PB is bound, as shown in FIG. 19B, the sheet bundle PB is held between the upper tooth die part 261*a* and the lower tooth die part 261*b*, and the link mechanism 270 is locked. The eccentric cam 276 is further rotated in the same direction, and the rotating shaft 276*a* is displaced toward the link mechanism 270. Then, the cam mechanism 277 is brought into a state where an angle θ between a virtual straight line extending in a direction of the long axis of the eccentric cam 276 and a virtual straight line extending in a horizontal direction satisfies θ=180[°]. Thereby, the maximum pressure can be applied to the sheet bundle PB by the upper tooth die part 261*a* and the lower tooth die part 261*b* regardless of the thickness of the sheet bundle PB.

Incidentally, when θ=180[°] is satisfied, the adjustment plate 272*a* is configured to swing toward the link mechanism 270 about the supporting point 272*b*, thereby moving the rotating shaft 276*a* toward the link mechanism 270 by a predetermined distance in the horizontal direction. Consequently, without being locked, the cam mechanism 277 can make the eccentric cam 276 rotate one revolution in one direction, and operate the link mechanism 270 so as to increase the degree of flexure, thereby increasing the distance between the tooth die parts. Accordingly, it is not necessary to perform control of rotating the eccentric cam 276 of the cam mechanism 277 in the opposite direction in order to increase the distance between the tooth die parts so that the sheet bundle PB can be taken out from between the tooth die parts after the sheet bundle PB has been bound, and therefore it is possible to simplify the control in binding.

Second Embodiment

Figure 20:
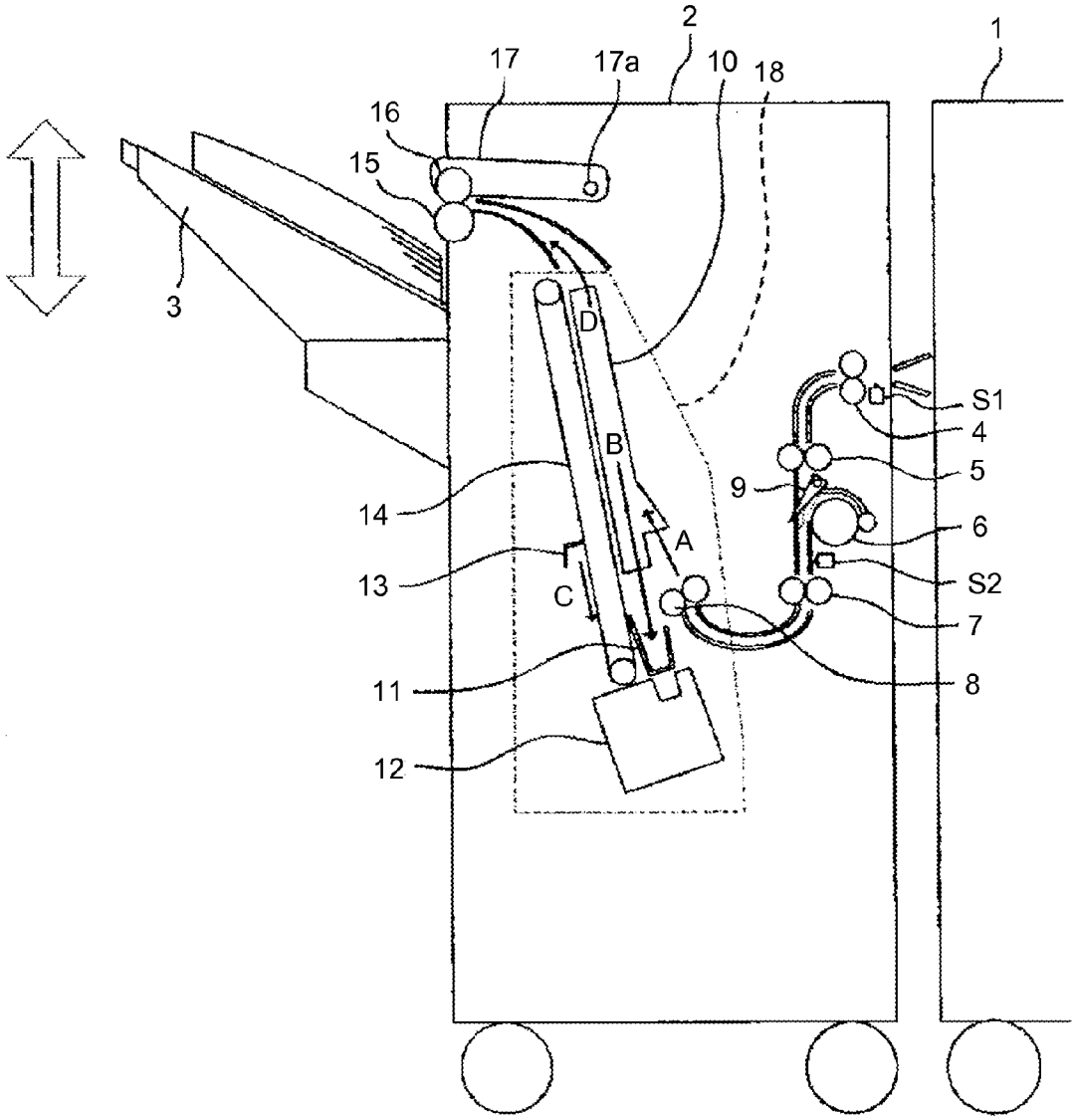
FIG. 20 is a diagram explaining how to superpose sheets on top of another in a conveyance path.

FIG. 20 is a schematic diagram of the image forming system including the image forming apparatus 101 for forming an image on a sheet and the sheet post-processing apparatus 201 for binding a bundle of sheets on which images have been formed by the image forming apparatus 101.

How to superpose sheets on top of another in a conveyance path is explained with FIG. 20.

A sheet output from the image forming apparatus 101 is fed into the sheet post-processing apparatus 201, and is conveyed by conveyance rollers 4 and 5, and a switching claw 9 is turned by a moving force of the sheet, and the sheet passes through a conveyance path opened by the turning of the switching claw 9, and is conveyed to an alignment unit 18 by conveyance rollers 7 and 8. The conveyed sheet falls in a direction of an arrow B under its own weight, and is aligned in a conveying direction by a trailing end fence 11. The trailing end of the sheet is previously detected by a sensor S2, and after a period of time enough to align the sheet in the conveying direction, the sheet is aligned in a width direction by an alignment fence 10. By repeating these actions, a number of sheets can be aligned one by one.

After the last sheet has been aligned, crimp binding is performed on the aligned sheet bundle by a crimp binding device 12, and a release belt 14 in the alignment unit 18 is rotated in a direction of an arrow C, and a release claw 13 attached to the release belt 14 releases the sheet bundle in a direction of an arrow D. The sheet bundle is discharged and stacked on a tray 3 by a discharge roller 15 and a driven roller 16. The tray 3 has a mechanism of moving up and down according to the number of stacked sheets.

The driven roller 16 is attached to a conveyance guide plate 17, and is configured to be capable of turning about a supporting point 17*a*, and pressure is applied to the discharge roller 15 under the weight of the conveyance guide plate 17. That is the operation in the case of one copy.

If there are two or more copies, the image forming apparatus 101 sequentially feeds copies into the sheet post-processing apparatus 201 at the same interval between the last sheet of a copy and the first sheet of the next copy as in other cases.

The processing operation for the second and subsequent copies is explained with reference to FIGS. 21A, 21B, 21C, and 21D.

Figure 21A:
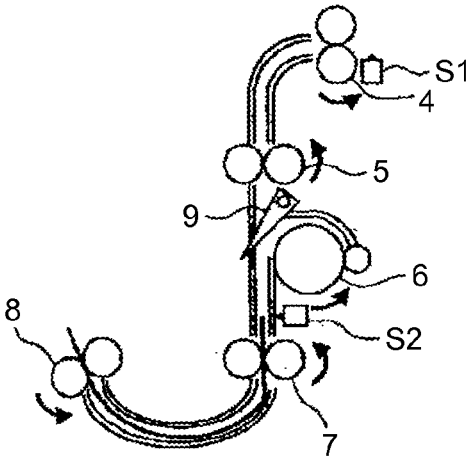
FIGS. 21A to 21D are diagrams explaining the processing operation for the second and subsequent copies.
Figure 21B:
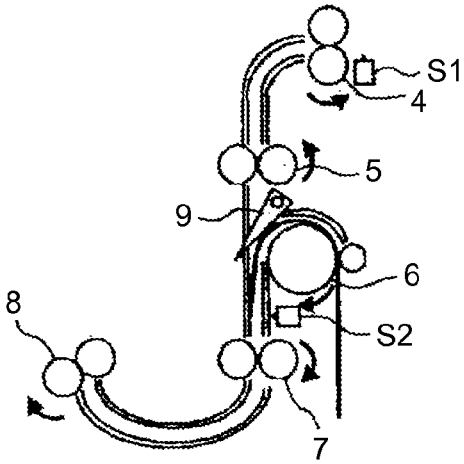

The conveyance rollers 4 and 5 rotate in a direction of an arrow shown in FIG. 21A, and the first sheet of the second copy is conveyed. The sensor S2 detects the trailing end of the sheet, and if the alignment unit 18 is not in a fit state to receive the sheet, the conveyance rollers 6, 7, and 8 rotate backward in a direction of an arrow shown in FIG. 21B. Then, the sheet is conveyed as shown in FIG. 21B by the switching claw 9, and is stopped once the sensor S2 has detected the end of the sheet.

Figure 21C:
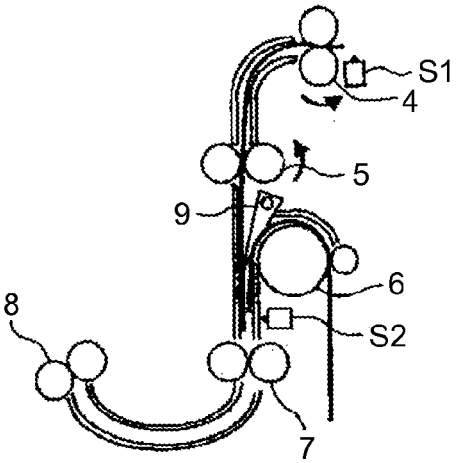
Figure 21D:
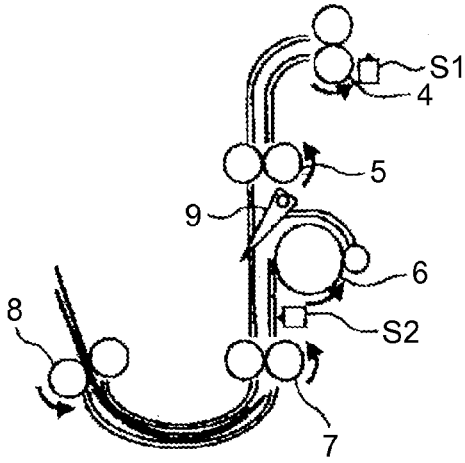

The second sheet of the second copy is conveyed by the conveyance rollers 4 and 5 as shown in FIG. 21C, and when the sensor S2 has detected the leading end of the sheet, the conveyance rollers 6, 7, and 8 rotate in a direction of an arrow shown in FIG. 21D, and convey the two sheets superposed on top of another. At this time, when the sensor S2 has detected the trailing end of these sheets, if the alignment unit 18 is in a fit state to receive the sheets, the sheets are discharged. On the other hand, if the alignment unit 18 is not in a fit state to receive the sheets, the same operation as the first sheet is repeatedly performed. In this manner, after the same operation as the first sheet is repeatedly performed on the second and subsequent sheets of the second copy until the alignment unit 18 is in a fit state to receive the sheets, the two or more sheets superposed on top of another are discharged.

Through the above operation, post-processing can be efficiently performed without decreasing the productivity at the time of stapling of two or more copies.

Furthermore, as a configuration of the crimp binding device 12 according to the present embodiment, the same configuration as the crimp binding device 280 according to the first embodiment can be adopted, and the same effects as the crimp binding device 280 according to the first embodiment can be achieved.

The above-described effects are just examples, and the present invention can achieve an effect specific to each of the following modes.

(Mode A)

In a sheet binding device such as the crimp-binding type of crimp binding device 280 that includes a pair of soothing crimping members such as the tooth dies 261 and a movable-crimping-member moving unit such as the squeeze crimping mechanism 269 for moving a movable crimping member which is one of the pair of crimping members such as the movably-installed lower tooth die part 261*b*, and binds a sheet bundle by causing the movable-crimping-member moving unit to move the movable crimping member thereby holding the sheet bundle such as a sheet bundle PB between the pair of crimping members, the movable-crimping-member moving unit includes a link mechanism, a connecting member, and a connecting-member moving unit; the link mechanism such as the link mechanism 270 includes a first link member such as the first connecting rod 270*a* having one end rotatably connected to the movable crimping member, a second link member such as the second connecting rod 270*b* having one end rotatably connected to a fixed member such as the fixed member 270*f* fixed to a device body, and a connecting part such as the first joint 269*a* that rotatably connects the other end of the first link member and the other end of the second link member; the connecting member such as the third connecting rod 271*a* has one end rotatably connected to the connecting part of the link mechanism, and is capable of moving between a first position causing the link mechanism to be extended and a second position retracted from the first position and causing the link mechanism to be more flexed than in the first position; the connecting-member moving unit such as the crank mechanism 271 includes a rotary member such as the rotating rod 271*c* capable of rotating on a displaceable rotating shaft such as the rotating shaft 271*b*, and reciprocates the connecting member between the first position and the second position by rotation of the rotary member in one direction. Accordingly, it is possible to simplify the control in binding regardless of the thickness of a sheet bundle as described in the above embodiment.

(Mode B)

In (Mode A), the rotating shaft can be displaced according to the thickness of a sheet bundle. Accordingly, it is possible to rotate the rotary member in one direction without locking the connecting-member moving unit as described in the above embodiment.

(Mode C)

in (Mode A) or (Mode B), the sheet binding device includes a biasing unit such as the spring 273*a* for biasing the rotating shaft so that the rotating shaft is subjected to force and thereby the sheet bundle is pressed with the movable crimping member. Accordingly, the pair of crimping members can apply pressure to the sheet bundle as described in the above embodiment.

(Mode D)

In (Mode C), the biasing unit is a spring member having a spring property causing the pressure applied to the sheet bundle by the pair of crimping members to be at a predetermined level regardless of the thickness of the sheet bundle. Accordingly, it is possible to make the maximum applied pressure constant regardless of a thickness of the sheet bundle as described in the above embodiment.

(Mode E)

In (Mode C), the biasing unit is a spring member having a spring property causing the pressure applied to the sheet bundle by the pair of crimping members to be greater as the thickness of the sheet bundle is greater. Accordingly, it is possible to make the maximum applied pressure greater as the thickness of a sheet bundle is greater as described in the above embodiment.

(Mode F)

In (Mode C), (Mode D), or (Mode F), applied pressure generated between the crimping members when the pair of crimping members is brought into contact without holding any sheet bundle between them is smaller than the maximum applied pressure generated between the crimping members when the sheet bundle is held between the pair of crimping members. Accordingly, it is possible to suppress damage to the crimping members in the event of idle binding as described in the above embodiment.

(Mode G)

In (Mode A), (Mode B), (Mode C), (Mode D), (Mode E), or (Mode F), the connecting-member moving unit includes a crank mechanism such as the crank mechanism 271, and a plate-like member such as the rotating rod 271*c* having one end connected to the rotating shaft such as the rotating shaft 271*b* and the other end rotatably connected to the connecting member such as the third connecting rod 271*a* can be used as the rotary member.

(Mode H)

In (Mode A), (Mode B), (Mode C), (Mode D), (Mode E), or (Mode F), the connecting-member moving unit includes a cam mechanism such as the cam mechanism 277, and an eccentric cam such as the eccentric cam 276 which capable of rotating on the rotating shaft such as the rotating shaft 276*a* can be used as the rotary member.

(Mode I)

In a sheet processing apparatus including at least a sheet binding device for binding a sheet bundle, as the sheet binding device, the sheet binding device in any of (Mode A), (Mode B), (Mode C), (Mode D), (Mode E), (Mode F), (Mode C), and (Mode H) is used. Accordingly, it is possible to simplify the control in binding regardless of the thickness of a sheet bundle as described in the above embodiment.

(Mode J)

In an image forming apparatus such as the image forming apparatus 101 that includes an image forming unit such as the image forming engine unit 110 which forms an image on a sheet and a sheet binding device such as the crimp binding device 280 which binds a bundle of sheets on which images have been formed by the image forming unit, as the sheet binding device, the sheet binding device in any of (Mode A), (Mode B), (Mode C), (Mode D), (Mode E), (Mode F), (Mode C), and (Mode H) is used. Accordingly, it is possible to simplify the control in binding regardless of the thickness of a sheet bundle as described in the above embodiment.

(Mode K)

In an image forming system that includes an image forming apparatus such as the image forming apparatus 101 which forms an image on a sheet and a sheet binding device such as the crimp binding device 280 which binds a bundle of sheets on which images have been formed by the image forming apparatus, as the sheet binding device, the sheet binding device in any of (Mode A), (Mode B), (Mode C), (Mode D), (Mode E), (Mode F), (Mode G), and (Mode H) is used. Accordingly, it is possible to simplify the control in binding regardless of the thickness of a sheet bundle as described in the above embodiment.

(Mode L)

In a sheet binding method of binding a sheet bundle by moving a movable crimping member which is one of a pair of toothing crimping members thereby holding the sheet bundle between the pair of crimping members, a connecting member having one end connected to a connecting part of a link mechanism, which includes a first link member having one end rotatably connected to the movable crimping member, a second link member having one end rotatably connected to a fixed member fixed to the device body, and the connecting part that rotatably connects the other end of the first link member and the other end of the second link member, is reciprocated between a first position causing the link mechanism to be extended and a second position retracted from the first position and causing the link mechanism to be more flexed than in the first position by rotation of a rotary member, which is capable of rotating on a displaceable rotating shaft, in one direction. Accordingly, it is possible to simplify the control in binding regardless of the thickness of a sheet bundle as described in the above embodiment.

(Mode M)

In (Mode L), the rotating shaft is biased by a biasing unit so that the rotating shaft is subjected to force and thereby the sheet bundle is pressed with the movable crimping member. Accordingly, the pair of crimping members can apply pressure to the sheet bundle as described in the above embodiment.

In the embodiment, even when a link mechanism is locked, a rotating shaft of a rotary member is displaced so that a connecting member can be moved between a first position and a second position by further rotating the rotary member in the same direction. Consequently, after a sheet bundle has been bound, the rotary member is further rotated in the same direction as at the binding of the sheet bundle, thereby moving the connecting member from the first position to the second position and inflecting the link mechanism so that the link mechanism is released, and therefore the space between crimping members can be increased to a predetermined interval. Accordingly, the control in binding can be simplified regardless of the thickness of a sheet bundle as compared with the case where after a sheet bundle has been bound, the rotary member is rotated by a rotation amount according to the thickness of the sheet bundle in a direction opposite to the rotation direction at the time of binding the sheet bundle, and thereby the space between the crimping members is increased to the predetermined interval.

According to the embodiment, it is possible to achieve such a beneficial effect that the control in binding can be simplified regardless of the thickness of a sheet bundle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp-binding type of sheet binding device comprising:

a pair of toothing crimping members; and a movable-crimping-member moving unit that moves a movable crimping member which is one of the pair of crimping members and is movably installed, wherein the sheet binding device binds a sheet bundle by causing the movable-crimping-member moving unit to move the movable crimping member thereby holding the sheet bundle between the pair of crimping members, and the movable-crimping-member moving unit includes:

a link mechanism that includes a first link member having one end rotatably connected to the movable crimping member, a second link member having one end rotatably connected to a fixed member fixed to a device body, and a connecting part that rotatably connects the other end of the first link member and the other end of the second link member;

a connecting member having one end rotatably connected to the connecting part of the link mechanism, and capable of moving between a first position causing the link mechanism to be extended and a second position retracted from the first position and causing the link mechanism to be more flexed than in the first position; and a connecting-member moving unit that includes a rotary member capable of rotating on a displaceable rotating shaft, and reciprocates the connecting member between the first position and the second position by rotation of the rotary member in one direction.

2. The sheet binding device according to claim 1, wherein the rotating shaft is capable of being displaced according to the thickness of a sheet bundle.

3. The sheet binding device according to claim 1, further comprising a biasing unit that biases the rotating shaft so that the rotating shaft is subjected to force and thereby the sheet bundle is pressed with the movable crimping member.

4. The sheet binding device according to claim 3, wherein the biasing unit is a spring member having a spring property causing pressure applied to the sheet bundle by the pair of crimping members to be at a predetermined level regardless of the thickness of the sheet bundle.

5. The sheet binding device according to claim 3, wherein the biasing unit is a spring member having a spring property causing pressure applied to the sheet bundle by the pair of crimping members to be greater as the thickness of the sheet bundle is greater.

6. The sheet binding device according to claim 3, wherein applied pressure generated between the crimping members when the pair of crimping members is brought into contact without holding any sheet bundle between them is smaller than maximum applied pressure generated between the crimping members when the sheet bundle is held between the pair of crimping members.

7. The sheet binding device according to claim 1, wherein the connecting-member moving unit includes a crank mechanism, and the rotary member is a plate-like member having one end connected to the rotating shaft and the other end rotatably connected to the connecting member.

8. The sheet binding device according to claim 1, wherein the connecting-member moving unit includes a cam mechanism, and the rotary member is an eccentric cam capable of rotating on the rotating shaft.

9. A sheet processing apparatus comprising at least a sheet binding device that binds a sheet bundle, wherein as the sheet binding device, the sheet binding device according to claim 1 is used.

10. An image forming apparatus comprising:

an image forming unit that forms an image on a sheet; and a sheet binding device that binds a bundle of sheets on which images have been formed by the image forming unit, wherein as the sheet binding device, the sheet binding device according to claim 1 is used.

11. An image forming system comprising:

an image forming apparatus that forms an image on a sheet; and a sheet binding device that binds a bundle of sheets on which images have been formed by the image forming apparatus, wherein as the sheet binding device, the sheet binding device according to claim 1 is used.

12. A sheet binding method of binding a sheet bundle by moving a movable crimping member which is one of a pair of toothing crimping members thereby holding the sheet bundle between the pair of crimping members, wherein a connecting member having one end connected to a connecting part of a link mechanism, which includes a first link member having one end rotatably connected to the movable crimping member, a second link member having one end rotatably connected to a fixed member fixed to a device body, and the connecting part that rotatably connects the other end of the first link member and the other end of the second link member, is reciprocated between a first position causing the link mechanism to be extended and a second position retracted from the first position and causing the link mechanism to be more flexed than in the first position by rotation of a rotary member, which is capable of rotating on a displaceable rotating shaft, in one direction.

13. The sheet binding method according to claim 12, wherein the rotating shaft is biased by a biasing unit so that the rotating shaft is subjected to force and thereby the sheet bundle is pressed with the movable crimping member.

* * * * *